United States Patent [19]

Kato et al.

[11] Patent Number: 5,073,470

[45] Date of Patent: Dec. 17, 1991

[54] LIQUID DEVELOPER FOR ELECTROSTATIC PHOTOGRAPHY

[75] Inventors: Eiichi Kato; Hideyuki Hattori, both of Shizuoka, Japan

[73] Assignee: Fuji Photo Film Co., Ltd., Kanagawa, Japan

[21] Appl. No.: 466,811

[22] Filed: Jan. 18, 1990

[30] Foreign Application Priority Data

Jan. 18, 1989 [JP] Japan ..... 1-007712
Oct. 30, 1989 [JP] Japan ..... 1-279966

[51] Int. Cl.[5] ..... G03G 9/12
[52] U.S. Cl. ..... 430/114; 430/115
[58] Field of Search ..... 430/114, 115, 137, 904

[56] References Cited

U.S. PATENT DOCUMENTS

| | | | |
|---|---|---|---|
| 4,837,102 | 6/1989 | Dan et al. | 430/114 |
| 4,840,865 | 6/1989 | Kato et al. | 430/114 |
| 4,983,486 | 1/1991 | Kato et al. | 430/115 |
| 5,006,441 | 4/1991 | Kato | 430/114 |

*Primary Examiner*—John Goodrow
*Attorney, Agent, or Firm*—Sughrue, Mion, Zinn, Macpeak & Seas

[57] ABSTRACT

A liquid developer for electrostatic photography comprising resin grains dispersed in a non-aqueous solvent having an electric resistance of at least $10^9$ cm and a dielectric constant of not higher than 3.5 is disclosed. The dispersed resin grains contained therein are grains of a copolymer obtained by polymerizing a solution containing at least one monofunctional monomer (A) which is soluble in the aforesaid non-aqueous solvent but becomes insoluble after being polymerized and at least one monfunctional macromonomer (M) having a number average molecular weight of not more than $1\times10^4$ and having a polymerizable double bond group represented by formula (M-II) bonded to only one terminal of a polymer main chain composed of a recurring unit represented by formula (M-I) in the presence of a dispersion stabilizing resin which is a polymer having at least a recurring unit represented by formula (I), a part of which has been crosslinked, and has a polymerizable double bond group copolymerizable with the monofunctional monomer (A) bonded to only one terminal of at least one polymer main chain thereof, the dispersion stabilizing resin being soluble in the non-aqueous solvent.

The liquid developer is excellent in redispersibility, storability, stability, image-reproducibility and fixability.

8 Claims, No Drawings

LIQUID DEVELOPER FOR ELECTROSTATIC PHOTOGRAPHY

FIELD OF THE INVENTION

This invention relates to a liquid developer for electrophotography, which comprises a resin dispersed in a liquid carrier having an electric resistance of at least $10^9$ Ω cm and a dielectric constant of not higher than 3.5, and more particularly to a liquid developer excellent in re-dispersibility, storability, stability, image-reproducibility, and fixability.

BACKGROUND OF THE INVENTION

In general, a liquid developer for electrophotography is prepared by dispersing an inorganic or organic pigment or dye such as carbon black, nitrosine, phthalocyanine blue, etc., a natural or synthetic resin such as an alkyd resin, an acrylic resin, rosine, synthetic rubber, etc., in a liquid having a high electric insulating property and a low dielectric constant, such as a petroleum aliphatic hydrocarbon, and further adding a polarity-controlling agent such as a metal soap, lecithin, linseed oil, a higher fatty acid, a vinyl pyrrolidone-containing polymer, etc. to the resulting dispersion.

In such a developer, the resin is dispersed in the form of insoluble latex grains having a grain size of from several μm to several hundred nm. In a conventional liquid developer, however, the soluble dispersion-stabilizing resin and the polarity-controlling agent are insufficiently bonded to the insoluble latex grains, so that the soluble dispersion-stabilizing resin and the polarity-controlling agent become freely dispersed in the liquid developer with ease. Accordingly, the soluble dispersion-stabilizing resin would be split off from the insoluble latex grains after storage of the liquid developer for a long period of time or after repeated use thereof, so that the grains would thereafter defectively precipitate, coagulate or accumulate, or the polarity would thereby become indistinct. Since the grains once coagulated and accumulated are reluctant to redisperse, the grains would be adhered to everywhere in the developing machine, and, as a result, cause stain of images formed and malfunction of the developing machine such as clogging of the liquid-feeding pump.

In order to overcome such defects, a means of chemically bonding the soluble dispersion-stabilizing resin and the insoluble latex grains is disclosed in U.S. Pat. No. 3,990,980. However, the liquid developer disclosed was still insufficient, although the dispersion stability to spontaneous precipitation of the grains was improved in some degree. When the liquid developer was actually used in a developing apparatus, the toner adhered to parts of the apparatus and solidified to form a film thereon, and the thus solidified toner grains could hardly be re-dispersed. In addition, the solidified toner grains caused stain of the images duplicated and troubles in the apparatus. Accordingly, the liquid dispersion as disclosed in U.S. Pat. No. 3,990,980 was found to have a defect that the redispersion stability was still insufficient for practical use.

In accordance with the method of preparing the resin grains as disclosed in U.S. Pat. No. 3,990,980, there is an extreme limitation on the combination of the dispersing stabilizer to be used and the monomers to be insolubilized, in order to prepare monodispersed grains having a narrow grain size distribution. Mostly, the resin grains prepared by the method would contain a large amount of coarse grains having a broad grain size distribution, or would be polydispersed grains having two or more different mean grain sizes. In accordance with such a method, it is difficult to obtain monodispersed grains having a narrow grain size distribution and having a desired mean grain size, and the method often results in large grains having a grain size of 1 μm or more, or extremely fine grains having a grain size of 0.1 μm or less. In addition, the dispersion stabilizer to be used in the method has another problem in that it must be prepared by an extremely complicated process requiring a long reaction time.

In order to overcome the aforesaid defects, a method of improving the dispersibility, the redispersibility, and the storage stability of insoluble dispersion resin grains by forming the grains of a copolymer from a monomer to be insolubilized and a monomer containing a long chain alkyl moiety is disclosed in JP-A-60-179751 (corresponding to EP-A-155788) and JP-A 62-151868 (the term "JP-A" as used herein means an "unexamined published Japanese patent application").

Also, a method of improving the dispersibility, the re-dispersibility, and the storage stability of insoluble dispersion resin grains by forming the grains by polymerizing a monomer being stabilized in the presence of a polymer utilizing a di-functional monomer or a polymer utilizing a high polymer reaction is disclosed in JP-A-60-185962 and JP-A-61-43757.

On the other hand, a method of printing a large number of prints of 5000 or more prints has recently been developed, using an offset printing master plate by electrophotography. In particular, because of further improvement of the master plate, it has become possible to print 10,000 or more prints of large size by electrophotography. In addition, noticeable progress has been made in shortening the operation time in an electrophotomechanical system, and the step of development-fixation in the system has been conveniently accelerated.

The grains prepared by the methods disclosed in aforesaid JP-A-60-179751 and JP-A-61-151868 might be good in the mono-dispersibility, re-dispersibility, and storage stability of the grains, but showed unsatisfactory performance with respect to the printability for master plates of a large size and quickening of the fixation time.

Also, the dispersion resin grains prepared by the methods disclosed in aforesaid JP-A-60-185962 and 61-43757 were not always satisfactory in the points of the dispersibility and re-dispersibility of the grains and in the point of printability in the case of a shortened fixation time or in the case of master plates of a large size (e.g., A-3 size ($297 \times 420$ mm$^2$)) or larger.

SUMMARY OF THE INVENTION

This invention has been made for solving the aforesaid problems inherent in conventional liquid developers.

An object of this invention is to provide a liquid developer excellent in dispersion stability, redispersibility, and fixability, and in particular to provide a liquid developer excellent in dispersion stability, re-dispersibility, and fixability even in an electrophotomechanical system wherein the development-fixation step is quickened and master plates of a large size are used.

Another object of the present invention is to provide a liquid developer capable of forming an offset printing plate precursor having excellent ink-receptivity to printing ink and excellent printing durability by electrophotography.

Still another object of the present invention is to provide a liquid developer which is suitable for various electrostatic photographic uses and various transferring uses, in addition to the above-mentioned uses.

A further object of the present invention is to provide a liquid developer which can be used in any and every liquid developer-using system, for example, for ink-jet recording, cathode ray tube recording, or recording by pressure variation or electrostatic variation.

The above described objects can be attained by the present invention as set forth hereinbefore.

According to this invention, there is provided a liquid developer for electrostatic photography comprising resin grains dispersed in a non-aqueous solvent having an electric resistance of at least $10^9$ Ω cm and a dielectric constant of not higher than 3.5, wherein the dispersed resin grains are grains of a copolymer obtained by polymerizing a solution containing at least one monofunctional monomer (A) which is soluble in the aforesaid non-aqueous solvent, but becomes insoluble after being polymerized and at least one monofunctional macromonomer (M) having a number average molecular weight of not more than $1\times10^4$ and having a polymerizable double bond group represented by following formula (M-II) bonded to only one terminal of a polymer main chain composed of a recurring unit represented by following formula (M-I), in the presence of a dispersion-stabilizing resin which is a polymer having at least a recurring unit represented by the following formula (I), a part of which has been crosslinked, and has a polymerizable double bond group copolymerizable with the monofunctional monomer (A) bonded to only one terminal of at least one polymer main chain thereof, said dispersion-stabilizing resin being soluble in the non-aqueous solvent;

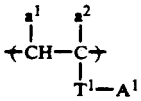

(I)

wherein $T^1$ represents —COO—, —OCO—, —$CH_2$OCO—, —$CH_2$COO—, —O— or —$SO_2$—; $A^1$ represents an aliphatic group having from 6 to 32 carbon atoms; and $a^1$ and $a^2$, which may be the same or different, each represents a hydrogen atom, a halogen atom, a cyano group, a hydrocarbon group having from 1 to 8 carbon atoms, —COO—$Z^1$ or —COO—$Z^1$ bonded via a hydrocarbon group having from 1 to 8 carbon atoms (wherein $Z^1$ represents a hydrogen atom or a hydrocarbon group having from 1 to 18 carbon atoms);

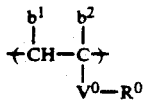

(M-I)

wherein $V^0$ represents —COO—, —OCO—, $\text{-}(CH_2)_l\text{-}$—COO—, $\text{-}(CH_2)_l\text{-}$OCO—, —O—, —$SO_2$—, —CONHCOO—, -CONHCONH-, —CON—,

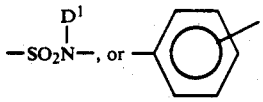

(wherein $D^1$ represents a hydrogen atom or a hydrocarbon group having from 1 to 22 carbon atoms and l represents an integer of from 1 to 3); $R^0$ represents a hydrocarbon group having from 1 to 22 carbon atoms, which may contain —O—, —CO—, —$CO_2$—, —OCO—, —$SO_2$—,

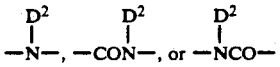

(wherein $D^2$ has the same meaning as $D^1$) in the carbon chain thereof, and $b^1$ and $b^2$, which may be the same or different, each represents a hydrogen atom, a halogen atom, a cyano group, a hydrocarbon group having from 1 to 8 carbon atoms, —COO—$D^3$, or —COO—$D^3$ bonded via a hydrocarbon group having from 1 to 8 carbon atoms (wherein $D^3$ represents a hydrogen atom or a hydrocarbon group having from 1 to 8 carbon atoms which may be substituted);

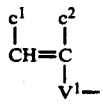

(M-II)

wherein $V^1$ has the same meaning as $V^0$ of formula (M-I) and $c^1$ and $c^2$, which may be the same or different, have the same meaning as $b^1$ and $b^2$ of formula (M-I).

DETAILED DESCRIPTION OF THE INVENTION

Then, the liquid developer of this invention is described in detail.

As the liquid carrier for the liquid developer of this invention having an electric resistance of at least $10^9$ Ω cm and a dielectric constant of not higher than 3.5, straight chain or branched aliphatic hydrocarbons, alicyclic hydrocarbons, aromatic hydrocarbons, and halogen-substituted derivatives thereof can be preferably used. Examples thereof are octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar: trade name of Exxon Co.), Shellsol 70, Shellsol 71 (Shellsol: trade name of Shell Oil Co.), Amsco OMS and Amsco 460 Solvent (Amsco: trade name of Americal Mineral Spirits Co.). They may be used singly or as a combination thereof.

The non-aqueous dispersion resin grains (hereinafter are often referred to as "latex grains") which are the most important constituting element in this invention are a copolymer resin obtained by polymerizing (a so-called polymerization granulation method) the aforesaid monomer (A) and the macromonomer (M) in the presence of the dispersion-stabilizing resin which is the polymer having at least a recurring unit represented by the aforesaid formula (I), a part of which has been crosslinked, has a polymerizable double bond group copolymerizable with the monofunctional monomer (A)

bonded to only one terminal of at least one polymer chain thereof, and is soluble in the non-aqueous solvent.

As the non-aqueous solvent for use in this invention, any solvents miscible with the aforesaid liquid carrier for the liquid developer for electrostatic photography can be basically used in this invention.

That is, the non-aqueous solvent being used in the production of the dispersion resin grains may be any solvent miscible with the aforesaid liquid carrier and preferably includes straight chain or branched aliphatic hydrocarbons, alicyclic hydrocarbons, aromatic hydrocarbons, and halogen-substituted derivatives thereof. Specific examples thereof are hexane, octane, isooctane, decane, isodecane, decalin, nonane, isododecane, and isoparaffinic petroleum solvents such as Isopar E, Isopar G, Isopar H, Isopar L, Shellsol 70, Shellsol 71, Amsco OMS, and Amsco 460. They may be used singly or as a combination thereof.

Other solvents which can be used together with the aforesaid organic solvent in this invention include alcohols (e.g., methanol, ethanol, propyl alcohol, butyl alcohol, and fluorinated alcohols), ketones (e.g., acetone, methyl ethyl ketone, and cyclohexanone), carboxylic acid esters (e.g., methyl acetate, ethyl acetate, propyl acetate, butyl acetate, methyl propionate, and ethyl propionate), ethers (e.g., diethyl ether, dipropyl ether, tetrahydrofuran, and dioxane), and halogenated hydrocarbons (e.g., methylene dichlorine, chloroform, carbon tetrachloride, dichloroethane, and methyl chloroform).

It is preferred that the non-aqueous solvents which are used as a mixture thereof are distilled off by heating or under a reduced pressure after the polymerization granulation. However, even when the solvent is carried in the liquid developer as a dispersion of the latex grains, it gives no problem if the liquid electric resistance of the developer is in the range of satisfying the condition of at least $10^9$ Ω cm.

In general, it is preferred that the same solvent as the liquid carrier is used in the step of forming the resin dispersion and as such a solvent, there are straight chain or branched aliphatic hydrocarbons, alicyclic hydrocarbons, aromatic hydrocarbons, halogenated hydrocarbons, etc., as described above.

The dispersion-stabilizing resin (dispersion stabilizer) which is used for forming a stable resin dispersion of the copolymer insoluble in the aforesaid non-aqueous solvent formed by copolymerizing the monofunctional monomer (A) and the macromonomer (M) in a non-aqueous solvent is a resin soluble in the non-aqueous solvent, which is a polymer having at least a recurring unit shown by the aforesaid formula (I), a part of which has been crosslinked, and has a polymerizable double bond group copolymerizable with the aforesaid monomer (A) bonded to only one terminal of at least one polymer main chain thereof, which is one of the features of this invention.

Then, the dispersion stabilizer (dispersion stabilizing resin) in this invention is described in detail.

In formula (I) showing the recurring unit of the copolymer component, the hydrocarbon groups may be substituted.

In formula (I), $T^1$ preferably represents —COO—, —OCO—, —$CH_2$OCO—, or —$CH_2$COO—.

$A^1$ preferably represents a hydrocarbon group having from 8 to 22 carbon atoms and includes practically aliphatic groups such as octyl, decyl, dodecyl, tridecyl, tetradecyl, hexadecyl, octadecyl, docosanyl, eicosanyl, octenyl, decenyl, dodecenyl, tridecenyl, tetradecenyl, hexadecenyl, octadecenyl, dococenyl, etc.

In formula (I), $a^1$ and $a^2$, which may be the same or different, each preferably represents a hydrogen atom, a halogen atom (e.g., fluorine, chlorine, and bromine), a cyano group, a hydrocarbon group having from 1 to 6 carbon atoms (e.g., methyl, ethyl, propyl, butyl, and phenyl), —COO—$Z^1$ or —COO—$Z^1$ bonded via a hydrocarbon group having from 1 to 6 carbon atoms (wherein $Z^1$ represents a hydrogen atom or a hydrocarbon atom having from 1 to 18 carbon atoms (e.g., methyl, ethyl, propyl, butyl, hexyl, octyl, decyl, dodecyl, tridecyl, tetradecyl, hexadecyl, octadecyl, butenyl, hexenyl, octenyl, decenyl, benzyl, phenethyl, phenyl, chlorobenzyl, bromobenzyl, methylbenzyl, chlorophenyl, bromophenyl, and tolyl)). More preferably, either $a^1$ or $a^2$ represents a hydrogen atom.

The dispersion-stabilizing resin in this invention may further have a recurring unit other than the recurring unit shown by the formula (I) in addition to the recurring unit of the formula (I).

Such recurring units other than that shown by the formula (I) which can be used in this invention include any monofunctional monomers copolymerizable with the monomer corresponding to the recurring unit shown by the formula (I).

As such other recurring unit, there are practically recurring units shown by the following formula (IV);

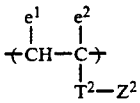

(IV)

wherein $T^2$ represents —COO—, —OCO—, —$CH_2$OCO—, —$CH_2$COO—, —$SO_2$—, —O—, —S—,

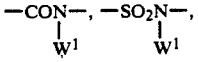

—NHCO—, —$CH_2$NHCO—, —NH$SO_2$—, —$CH_2$NH$SO_2$—, —CONHCOO—, —CONH$SO_2$—, —NHCONH— or

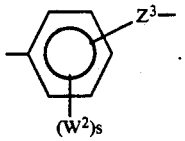

In the above formulae, $W^1$ represents a hydrogen atom or a substituted or unsubstituted hydrocarbon group having from 1 to 18 carbon atoms (e.g., methyl, ethyl, propyl, butyl, hexyl, octyl, decyl, dodecyl, tridecyl, octadecyl, 2-hydroxyethyl, 3-hydroxypropyl, 2-chloroethyl, 2-cyanoethyl, 2-methoxycarbonylethyl, 2-carboxyethyl, butenyl, hexenyl, octenyl, cyclohexyl, benzyl, phenethyl, phenyl, tolyl, naphthyl, chlorophenyl, bromophenyl, methoxyphenyl, bromobenzyl, methylbenzyl, and methoxybenzyl) and $W^2$ represents a hydrogen atom, a halogen atom (e.g., fluorine, chlorine, and bromine), an alkyl group (e.g., methyl, ethyl, propyl, chloromethyl, hydroxymethyl, N,N-dimethylaminomethyl, and N,N-diethylaminomethyl), a hydroxy group, a carboxy group or a sulfo group. In the above formula, s represents an integer of from 1 to 4.

In the above formula, $Z^3$ represents a linkage group or a bond linking between $Z^2$ and the benzene ring, and is, for example, —COO—, $$-\underset{\underset{W^3}{|}}{CON}-,\ -CH_2O-,\ -\underset{\underset{W^3}{|}}{CH_2N}-,\ -O-,\ -S-,\ -\underset{\underset{W^3}{|}}{SO_2N}-,$$

a bond directly bonding between $Z^2$ and the benzene ring, etc., ($W^3$ has the same meaning as $W^1$).

In formula (IV), $Z^2$ represents a hydrogen atom, an unsubstituted hydrocarbon group having from 1 to 6 carbon atoms (e.g., methyl, ethyl, propyl, butyl, heptyl, hexyl, cycloheptyl, cyclohexyl, hexenyl, and phenyl), a substituted aliphatic group having from 1 to 22 carbon atoms [in which examples of the substituent include a halogen atom (e.g., fluorine, chlorine, bromine, and iodine), —OH, —SH, —COOH, $-SO_3H$, $-SO_2H$, $-PO_3H_2$, —CN, $-CONH_2$, $-SO_2NH_2$,

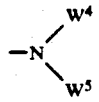

($W^4$ and $W^5$ each has the same meaning as $W^1$), —O-$COW^6$, —O—$W^6$, —S—$W^6$,

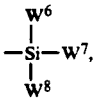

$-COOW^6$, $-SO_2W^6$ ($W^6$, $W^7$, and $W^8$ each represents a hydrocarbon group having from 1 to 18 carbon atoms, which may be substituted, and has practically the same meaning as $W^1$)], a heterocyclic group (e.g., thiophene, pyran, furan, pyridine, morpholine, piperidine, imidazole, benzimidazole, and thiazole), or an aromatic group which may be substituted (e.g., phenyl, naphthyl, tolyl, xylyl, mesityl, fluorophenyl, chlorophenyl, bromophenyl, dichlorophenyl, dibromophenyl, trifluoromethylphenyl, hydroxyphenyl, methoxyphenyl, carboxyphenyl, sulfophenyl, carboxyamidophenyl, sulfoamidophenyl, methoxycarbonylphenyl, acetamidophenyl, cyanophenyl, nitrophenyl, and methanesulfonylphenyl).

In formula (IV), $e^3$ and $e^4$, which may be the same or different, each has the same meaning as $a^1$ and $a^2$ in the formula (I) described above.

Furthermore, the polymer in this invention may contain monomers other than the monomer corresponding to the recurring unit shown by the above formula (IV), and examples thereof are maleic acid, maleic anhydride, itaconic anhydride, vinylnaphthalenes, and vinyl heterocyclic compounds having a vinyl group directly substituted to the ring (e.g., vinylpyridine, vinylimidazole, vinylthiophene, vinylpyrrolidone, vinylbenzoimidazole, and vinyltriazole).

The dispersion stabilizing resin of this invention is a polymer containing a polymer component selected from the recurring units shown by formula (I) as the homopolymer component or as a copolymer component. This polymer is obtained by copolymerizing the monomer corresponding to the recurring unit shown by (I) with another monomer copolymerizable with the monomer corresponding to the recurring unit (I) (e.g., a monomer corresponding to the recurring unit shown by aforesaid formula (IV) as a copolymerizable copolymer component, a pat of the polymer being crosslinked, and the polymer has a polymerizable double bond group bonded to only one terminal of at least one polymer main chain.

When the dispersion stabilizing resin of this invention contains a copolymer obtained by copolymerizing a monomer corresponding to the recurring unit shown by formula (I) and other monomer (e.g., a monomer corresponding to the recurring unit shown by the formula (IV)) copolymerizable with said monomer as a copolymer component, the proportion of the monomer corresponding to the recurring unit shown by formula (I) is at least 30 parts by weight, preferably at least 50 parts by weight, and more preferably at least 70 parts by weight to 100 parts by weight of the whole monomers.

As a method of introducing the crosslinked structure into the polymer, a conventionally known method can be utilized.

That is, there is a method of polymerizing the monomer(s) in the presence of a polyfunctional monomer or a method of incorporating a functional group progressing a crosslinking reaction and performing the crosslinking by polymer reaction. A method of crosslinking the polymer and chain by polymerizing a monomer having at least two functional groups and a monomer corresponding to the recurring unit shown by formula (I) is preferred.

Practical examples of the polymerizable functional groups include $CH_2{=}CH-$, $CH_2{=}CH-CH_2-$, $$CH_2{=}CH-\overset{\overset{O}{\|}}{C}-O-,\ CH_2{=}\overset{\overset{CH_3}{|}}{C}-\underset{\underset{O}{\|}}{C}-O-,\ CH{=}CH-\overset{\overset{O}{\|}}{C}-O-,$$

$$CH_2{=}CH-CONH-,\ CH_2{=}\overset{\overset{CH_3}{|}}{C}-CONH-,$$

$$CH_2{=}CH-CONHCOO-,\ CH_2{=}\overset{\overset{CH_3}{|}}{C}-CONHCOO-,$$

$$CH_2{=}\overset{\overset{CH_3}{|}}{C}-CONHSO_2-,\ CH{=}\overset{\overset{CH_3}{|}}{C}H-CONHSO_2-,$$

$$\overset{\overset{CH_3}{|}}{CH}{=}CH-CONH-,\ CH_2{=}CH-O-\overset{\overset{O}{\|}}{C}-,\ CH_2{=}\overset{\overset{CH_3}{|}}{C}-O-\overset{\overset{O}{\|}}{C}-,$$

$$CH_2{=}CH-CH_2-O-\overset{\overset{O}{\|}}{C}-,$$

$CH_2{=}CH-NHCO-$, $CH_2{=}CH-CH_2-NHCO-$, $CH_2{=}CH-SO_2-$, $CH_2{=}CH-CO-$, $CH_2{=}CH-O-$, and $CH_2{=}CH-S-$. The monomer may have two or more the aforesaid polymerizable functional groups and in this case they may be the same or different.

Specific examples of the monomer having two or more polymerizable monomers are as follows.

Examples of the monomer having same polymerizable functional groups are styrene derivatives such as divinylbenzene, trivinylbenzene, etc.; methacrylic acid, acrylic acid, or crotonic acid esters of a polyhydric alcohol (e.g., ethylene glycol, diethylene glycol, triethylene glycol, polyethylene glycols #200, #400, and #600, 1,3-butylene glycol, neopentyl glycol, dipropylene glycol, polypropylene glycol, trimethylolpropane, trimethylolethane, and pentaerythritol) or a polyhydroxyphenol (e.g., hydroquinone, resorcinol, catechol, and the derivative thereof), vinyl ethers, and allyl ethers; vinyl esters of a dibasic acid (e.g., malonic acid, succinic acid, glutaric acid, adipic acid, pimelic acid, maleic acid, phthalic acid, and itaconic acid), allyl esters, vinylamides, and allyl amides; and condensates of polyamides (e.g., ethylenediamine, 1,3-propylenediamine, and 1,4-butylenediamine) and a carboxylic acid having a vinyl group (e.g., methacrylic acid, acrylic acid, crotonic acid, and allylacetic acid).

Also, examples of the monomer having different polymerizable functional groups are vinyl group-having ester derivatives or amide derivatives (e.g., vinyl methacrylate, vinyl acrylate, vinyl itaconate, allyl itaconate, allyl acrylate, allyl itaconate, vinyl methacryloylacetate, vinyl methacryloylpropionate, allyl methacryloylpropionate, methacrylic acid vinyloxycarbonyl methyl ester, acrylic acid vinyloxycarbonylmethyloxycarbonylethylene ester, N-allylacrylamide, N-allylmethacrylamide, N-allylitaconic acid amide, and methacryloylpropionic acid allyl amide) of vinyl group-having carboxylic acids (e.g., methacrylic acid, acrylic acid, methacryloylacetic acid, acryloylacetic acid, methacryloylpropionic acid, acryloylpropionic acid, itaconiloylacetic acid, itaconoloylpropionic acid, and reaction products of carboxylic acids and alcohols or amines (e.g., allyloxycarbonylpropionic acid, allyloxycarbonylacetic acid, 2-allyloxycarbonylbenzoic acid, and allylaminocarbonylpropionic acid)); and condensates of aminoalcohols (e.g., aminoethanol, 1-aminopropanol, 1-aminobutanol, 1-aminohexanol, and 2-aminobutanol) and vinyl group having carboxylic acids.

In this invention, by performing the polymerization using the monomer having two or more polymerizable functional groups in an amount of not more than 15% by weight, and preferably not more than 10% by weight of whole monomers, the partially crosslinked resin can be formed.

Also, the polymerizable double bond group bonding to one terminal only of the polymer chain has a chemical structure of directly bonding to one terminal of the polymer main chain or bonding thereto through an optional linkage group.

Practically, the polymerizable double bond group has the chemical structure shown by formula (V):

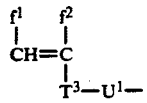

(V)

wherein $T^3$ has the same meaning as $T^2$ in the aforesaid formula (IV); $f^1$ and $f^2$, which may be the same or different, each has the same meaning as $e^1$ and $e^2$ in the aforesaid formula (IV); and $U^1$ represents a linkage group capable of bonding

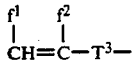

to one terminal of the polymer main chain directly or through an optional linkage group.

The linkage group is composed of an optional combination of the atomic groups of a carbon-carbon bond (single bond or double bond), a carbon-hetero atom bond (examples of the hetero atom are oxygen, sulfur, nitrogen, and silicon), or a hetero atom-hetero atom bond.

Examples of the linkage group are

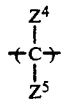

(wherein $Z^4$ and $Z^5$ each represents a halogen atom (e.g., fluorine, chlorine, and bromine), a cyano group, a hydroxy group, an alkyl group (e.g., methyl, ethyl, and propyl)),

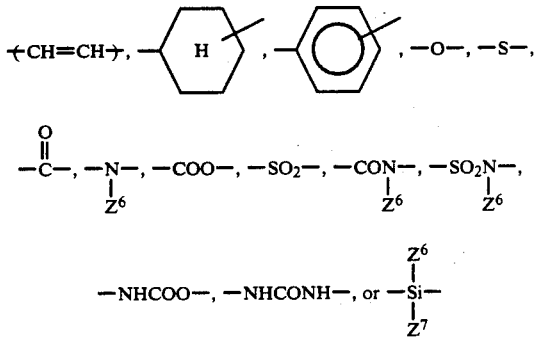

(wherein $Z^6$ and $Z^7$ each represents a hydrogen, a hydrocarbon group having from 1 to 8 carbon atoms (e.g., methyl, ethyl, propyl, butyl, pentyl, hexyl, benzyl, phenethyl, phenyl, and tolyl), or $-OZ^8$ (wherein $Z^8$ has the same meaning as the hydrocarbon group shown by $Z^6$)).

Then, the polymerizable double bond shown by the aforesaid formula (V), which is bonded to only one terminal of the polymer main chain, is practically shown below. In the practical examples shown below, A represents —H, $-CH_3$, or $-CH_2COOCH_3$; B represents —H or $-CH_3$; n represents an integer of from 2 to 10, m represents 2 or 3; l represents 1, 2 or 3; p represents an integer of from 1 to 4; and q represents 1 or 2.

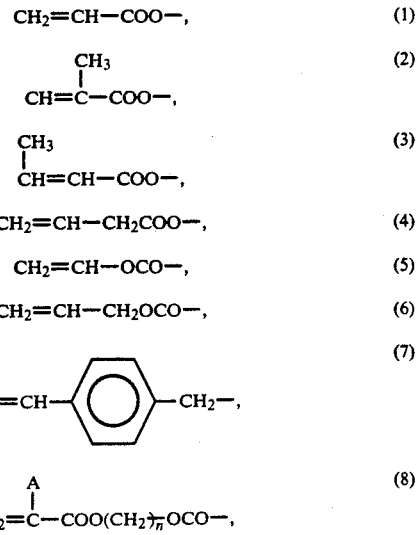

(1) $CH_2=CH-COO-$, (2) $CH=C(CH_3)-COO-$, (3) $CH(CH_3)=CH-COO-$, (4) $CH_2=CH-CH_2COO-$, (5) $CH_2=CH-OCO-$, (6) $CH_2=CH-CH_2OCO-$, (7) $CH_2=CH-C_6H_4-CH_2-$, (8) $CH_2=C(A)-COO(CH_2)_nOCO-$,

-continued (9)

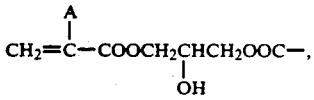

(10)

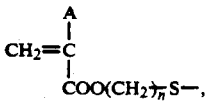

(11)

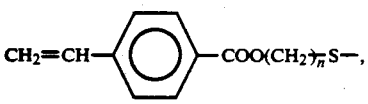

(12)

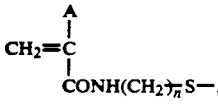

(13)

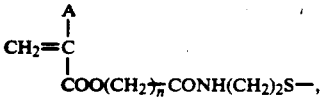

(14)

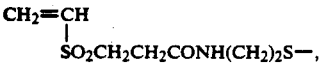

(15)

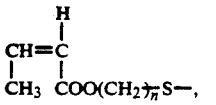

(16)

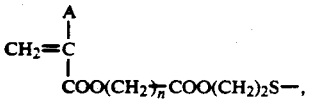

(17)

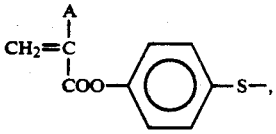

(18)

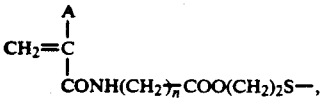

(19)

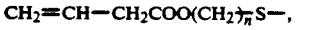

(20)

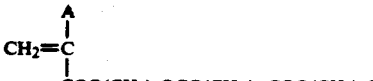

(21)

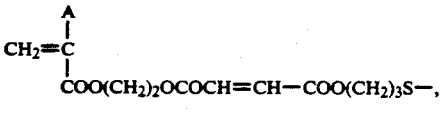

(22)

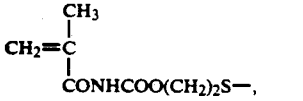

(23)

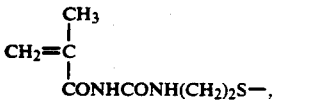

-continued (24)

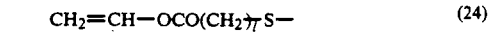

(25)

(26)

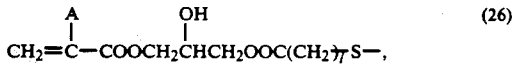

(27)

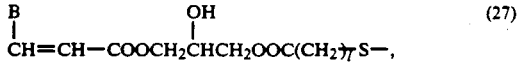

(28)

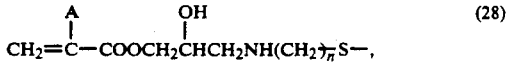

(29)

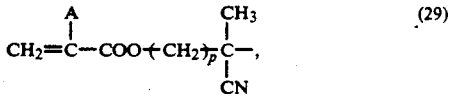

(30)

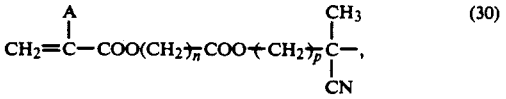

(31)

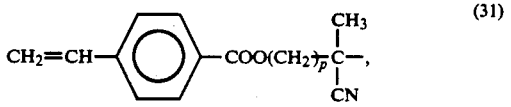

(32)

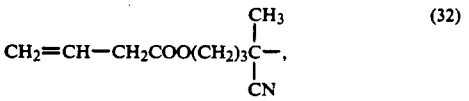

(33)

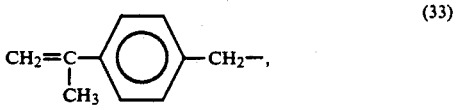

(34)

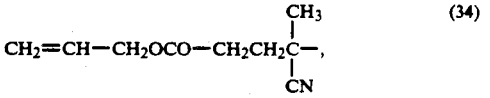

(35)

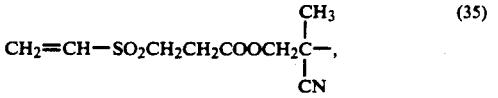

(36)

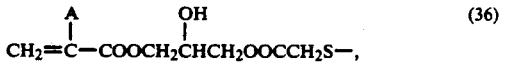

(37)

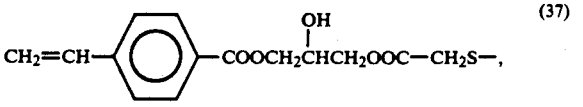

(38)

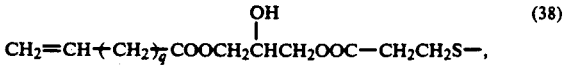

The dispersion-dispersing resin in this invention having the polymerizable double bond group bonded to only one terminal of the polymer main chain can be easily prepared by (1) a method of reacting various reagents to the terminal of a living polymer obtained by an anion polymerization or cation polymerization or (2) a method of reacting having a "specific reactive group"

(e.g., —OH, —COOH, $—SO_3H$, $—NH_2$, —SH, $—PO_3H_2$, —NCO, —NCS,

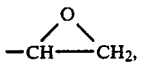

—COCl, and $—SO_2Cl$) to the terminal of the aforesaid living polymer and then introducing a polymerizable double bond group by a macromolecular reaction (a method by an ion polymerization), or (3) a method of performing a radical polymerization using a polymerization initiator and/or a chain transfer agent containing the aforesaid "specific reactive group" in the molecule and then introducing a polymerizable double bond group therein by performing a macromolecular reaction utilizing the "specific reactive group" bonded to only one terminal of the polymer main chain.

Practically, the polymerizable double bond group can be introduced into the polymer according to the methods described in P. Dreyfuss & R. P. Quirk, *Encycl. Polymer Sci. Eng.*, 7, 551(1987), Yoshiki Nakajo and Yuya Yamashita, *Senryo to Yakuhin* (*Dyes and Chemicals*), 30, 232(1985), Akira Ueda and Susumu Nagai, *Kagaku to Kogyo* (*Science and Industry*), 60 (1986), Koichi Ito, *Kobunshi Kako* (*Polymer Processing*), 35, 262(1986), V. Percec, *Applied Polymer Science*, 35, 97(1985) and the literature references cited therein.

Furthermore, more practically, a polymer having the "specific reactive group" bonded to only one terminal of the polymer main chain and the aforesaid crosslinked structure is produced by (1) a method of polymerizing a mixture of at least one monomer corresponding to the recurring unit shown by the aforesaid formula (I), a polyfunctional monomer for introducing the aforesaid crosslinked structure, and a chain transfer agent having the aforesaid "specific reactive group" in the molecule using a polymerization initiator (e.g., an azobis compound and a peroxide), (2) a method of polymerizing the aforesaid mixture without containing the chain transfer agent using a polymerization initiator having the aforesaid "specific reactive agent" in the molecule, or (3) a method of polymerizing the aforesaid mixture using the chain transfer agent and the polymerization initiator, each having the aforesaid "specific reactive group", and then a polymerizable double bond is introduced into the polymer by performing a macromolecular reaction utilizing the "specific reactive group".

Examples of the chain transfer agent include mercapto compounds each having the "specific reactive group" or a substituent capable of being induced into the "specific reactive group" (e.g., thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 1-mercapto-2-propanol, 3-mercapto-2-butanol, mercaptophenol, 2-mercaptoethylamine, 2-mercaptoimidazole, and 2-mercapto 3-mercapto-3-pyridinol) and iodized alkyl compounds each containing the "specific reactive group" or a substituent capable of being induced into the "specific reactive group" (e.g., indoacetic acid, iodopropionic acid, 2-iodoethanol, 2-iodoethanesulfonic acid, and 3-iodopropanesulfonic acid. In these compounds, the mercapto compounds are preferred.

Also, examples of the polymerization initiator containing the "specific reactive group" or a substituent capable of being induced into the "specific reactive group" include 4,4'-azobis(4-cyanovaleric acid), 4,4'-azobis(4-cyanovaleric acid chloride), 2,2'-azobis(2-cyanopropanol), 2,2'-azobis(2-cyanopentanol), 2,2'-azobis[2-(5-hydroxy-3,4,5,6-tetrahydropyrimidin-2-yl)propane], 2,2'-azobis{2-methyl-N-[1,1-bis(hydroxymethyl)-2-hydroxyethyl]propioamide}, 2,2'-azobis{2-methyl-N-[1,1-bis(hydroxymethyl)ethyl]propioamide}, 2,2'-azobis[2-methyl-N-(2-hydroxyethyl)propioamide], and 2,2'-azobis-(2-amidinopropane).

The amount of the chain transfer agent or the polymerization initiator is from about 0.5 to about 15 parts by weight, and preferably from 1 to 10 parts by weight to 100 parts by weight of the whole monomers.

The dispersion stabilizing resin for use in this invention may be soluble in an organic solvent, and practically the dispersion stabilizing resin of at least 5 parts by weight of which is soluble in 100 parts by weight of toluene at 25° C. may be used in this invention.

The weight average molecular weight of the dispersion stabilizing resin for use in this invention is from $1\times10^4$ to $1\times10^6$, and preferably from $3\times10^4$ to $5\times10^5$.

The monomers which are used for the production of the aforesaid non-aqueous dispersion resin grains (dispersed resin grains) are classified into the monofunctional monomer (A) which is soluble in the non-aqueous solvent, but becomes insoluble after being polymerized and the monofunctional macromonomer (M) forming a copolymer with the monomer (A).

As the monomer (A) for use in this invention, any monofunctional monomers which are insoluble in the non-aqueous solvent, but become insoluble thereon by being polymerized can be used. Practically, monomers shown by following formula (A-I) can be used:

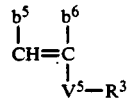

(A-I)

wherein $V^5$ represents —COO—, —OCO—, $—CH_2OCO—$, $—CH_2COO—$, —O—, —CONHCOO—, —CONHOCO—, $—SO_2—$,

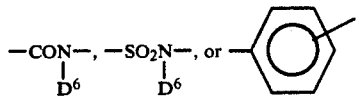

(wherein $D^6$ represents a hydrogen or an aliphatic group having from 1 to 18 carbon atoms, which may be substituted (e.g., methyl, ethyl, propyl, butyl, 2-chloroethyl, 2-bromoethyl, benzyl, chlorobenzyl, methylbenzyl, methoxybenzyl, phenethyl, 3-phenylpropyl, dimethylbenzyl, fluorobenzyl, 2-methoxyethyl, and 3-methoxypropyl)); $R^3$ represents a hydrogen atom or an aliphatic group having from 1 to 6 carbon atoms, which may be substituted (e.g., methyl, ethyl, propyl, butyl, 2-chloroethyl, 2,2-dichloroethyl, 2,2,2-trifluoroethyl, 2-bromoethyl, 2-glycidylethyl, 2-hydroxyethyl, 2-hydroxypropyl, 2,3-dihydroxypropyl, 2-hydroxy-3-chlororopyl, 2-cyanoethyl, 3-cyanopropyl, 2-nitroethyl, 2-methoxyethyl, 2-methanesulfonylethyl, 2-ethoxyethyl, N,N-dimethylaminoethyl, N,N-diethylaminoethyl, trimethoxysilylpropyl, 3-bromopropyl, 4-hydroxybutyl, 2-flufurylethyl, 2-thienylethyl, 2-pyridylethyl, 2-morpholinoethyl, 2-carboxyethyl, 3-carboxypropyl, 4-carboxybutyl, 2-phosphoethyl, 3-sulfopropyl, 4-sulfobutyl, 2-carboxyamidoethyl, 3-sulfoamidopropyl, 2-N-methylcarboxyamidoethyl, cyclopentyl, chlorocyclohexyl, and dichlorohexyl); and $b^5$ and $b^6$, which may be the same or different, each has the same meaning as $b^1$ or $b^2$ in the aforesaid formula (M-1).

Specific examples of monofunctional monomer (A) include vinyl esters or allyl esters of aliphatic carboxylic acids having from 1 to 6 carbon atoms (e.g., acetic acid, propionic acid, butyric acid, monochloroacetic acid, and trifluoropropionic acid); alkyl esters or alkylamides (the alkyl moiety having from 1 to 4 carbon atoms) of an unsaturated carboxylic acid such as acrylic acid, crotonic acid, itaconic acid, maleic acid, etc., (the alkyl group includes, for example, methyl, ethyl, propyl, butyl, 2-chloroethyl, 2-bromoethyl, 2-fluoroethyl, trifluoroethyl, 2-hydroxyethyl, 2-cyanoethyl, 2-nitroethyl, 2-methoxyethyl, 2-methanesulfonylethyl, 2-benzenesulfonylethyl, 2-(N,N-dimethylamino)-ethyl, 2-(N,N-diethylamino)ethyl, 2-carboxyethyl, 2-phosphoethyl, 4-carboxybutyl, 3-sulfopropyl, 4-sulfobutyl, 3-chloropropyl, 2-hydroxy-3-chloropropyl, 2-furfurylethyl, 2-pyridinylethyl, 2-thienylethyl, trimethoxysilylpropyl, and 2-carboxyamidoethyl); styrene derivatives (e.g., styrene, vinyltoluene, α-methylstyrene, vinylnaphthalene, chlorostyrene, dichlorostyrene, bromostyrene, vinylbenzenecarboxylic acid, vinylbenzenesulfonic acid, chlorome,thylstyrene, hydroxymethylstyrene, methoxymethylstyrene, N,N-dimethylaminomethylstyrene, vinylbenzenecarboxyamide, and vinylbenzenesulfoamide); unsaturated carboxylic acids such as acrylic acid, methacrylic acid, crotonic acid, maleic acid, itaconic acid, etc.; cyclic anhydrides of maleic acid and itaconic acid; acrylonitrile; methacrylonitrile; and heterocyclic compounds having a polymerizable double bond group (practical examples are the compounds described in *Polymer Date Handbook, Foundation*, pages 175 to 184, edited by Polymer Society of Japan, 1986, such as N-vinylpyridine, N-vinylimidazole, N-vinylpyrrolidone, vinylthiophene, vinyltetrahydrofuran, vinyloxazoline, vinylthiazole, N-vinylmorpholine, etc.

The monofunctional monomers (A) may be used singly or as a mixture thereof.

The monofunctional macromonomer (M) is a macromonomer having a number average molecular weight of not more than $1\times10^4$ having a polymerizable double bond group copolymerizable with the monomer (A) shown by the aforesaid formula (M-II) bonded to one terminal of the main chain of the polymer composed of the recurring unit shown by the aforesaid formula (M-I).

In the formulae (M-I) and (M-II), the hydrocarbon groups included in $b^1$, $b^2$, $V^0$, $R^0$, $c^1$, $c^2$, and $V^1$ each has the carbon atom number (as the unsubstituted hydrocarbon group) defined above and may be substituted.

In the formula (M-I), $D^1$ in the substituents shown by $V^0$ represents a hydrogen atom or a hydrocarbon group having from 1 to 22 carbon atoms and preferred examples of the hydrocarbon group are an alkyl group having from 1 to 22 carbon atoms, which may be substituted (e.g., methyl, ethyl, propyl, butyl, heptyl, hexyl, octyl, nonyl, decyl, dodecyl, tridecyl, tetradecyl, hexadecyl, octadecyl, eicosanyl, docosanyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms, which may be substituted (e.g., 2-methyl-1-propenyl, 2-butenyl, 2-pentenyl, 3-methyl 2-pentenyl, 1-pentenyl, 1-hexenyl, 2-hexenyl, 4-methyl-2-hexenyl, decenyl, octadecenyl, and linolenyl), an aralkyl group having from 7 to 12 carbon atoms, which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms, which may be substituted (e.g., cyclohexyl, 2-cyclohexylethyl, and 2-cyclopenthylethyl), and an aromatic group having from 6 to 12 carbon atoms, which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

When $V^0$ shows

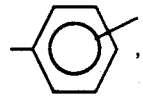

the benzene ring may have a substituent such as a halogen atom (e.g., chlorine and bromine), an alkyl group (e.g., methyl, ethyl, propyl, butyl, chloromethyl, and methoxymethyl).

$$-\overset{D^2}{\overset{|}{N}}-,\ -\overset{D^2}{\overset{|}{C}}ON-,\ \text{or}\ -\overset{D^2}{\overset{|}{N}}CO-$$

$R^0$ preferably represents a hydrocarbon group having from 1 to 22 carbon atoms and practically shows the same meaning as described above for $D^1$. $R^0$ may have —O—, —CO—, —$CO_2$—, —OCO—, —$SO_2$—, t,0410 (wherein $D^2$ has the same meaning as $D^1$).

In the formula (M-I), $b^1$ and $b^2$, which may be the same or different, each preferably represents a hydrogen atom, a halogen atom (e.g., chlorine and bromine), a cyano group, an alkyl group having from 1 to 3 carbon atoms (e.g., methyl, ethyl, and propyl), —$COOD^3$, or —$CH_2COOD_3$ (wherein $D^3$ represents a hydrogen atom, an alkyl group having from 1 to 18 carbon atoms, an alkenyl group, an aralkyl group, an aliphatic group, or an aryl group and each of these groups may be substituted and has the same meaning as those described above for $D^1$).

Furthermore, in the macromonomer (M) for use in this invention, $R^0$ in the formula (M-I) showing the recurring unit constituting the macromonomer preferably contains a component shown by following formula (M-Ia) having the features of containing at least one specific polar group shown by $B^1$ and at least one specific polar group shown by $B^2$ and thus having at least 2 specific polar groups as recurring unit moieties in the molecule

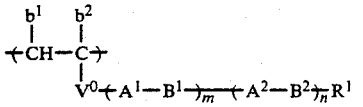

(M-Ia)

wherein $b^1$, $b^2$, and $V^0$ are same as described above; $B^1$ and $B^2$, which may be the same or different, each represents —O—, —CO—, —$CO_2$—, —OCO—, —$SO_2$—,

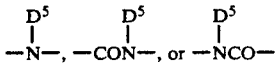

(wherein $D^5$ has the same meaning as $D^1$ in the aforesaid formula (M-I)); $A^1$ and $A^2$, which may be same or different, each represents a hydrocarbon group having from 1 to 18 carbon atoms, which may be substituted or may have

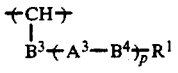

in the main chain bond (wherein the hydrocarbon group is an alkyl group, an alkenyl group, an aralkyl group, or an alicyclic group).

Preferred examples of the aforesaid aliphatic groups are the same as the preferred examples of the aliphatic group shown by $R^0$ in the formula (M-I) described above.

In the above formula, $B^3$ and $B^4$, which may be the same or different, have the same meaning as $B^1$ and $B^2$ described above and $A^3$ represents a hydrocarbon group having from 1 to 18 carbon atoms, which may be substituted, as shown by $A^1$ or $A^2$ described above.

Furthermore, practically, $A^1$ and $A^2$ in the formula (M-Ia) each is composed of an optional combination of the atomic group such as

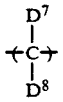

(wherein $D^7$ and $D^8$ each represents a hydrogen atom, an alkyl group, or a halogen atom),

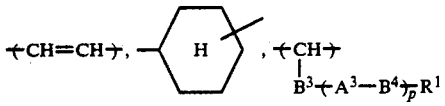

(wherein $B^3$, $B^4$, $A^3$, $R^1$, and p are same as described above), etc.

Furthermore, m, n, and p, which may be the same or different, each represents 0, 1, 2, or 3, with the proviso that m, n, and p cannot be 0 at the same time.

In the formula (M-Ia), $R^1$ represents a hydrogen atom or a hydrocarbon group having from 1 to 22 carbon atoms and preferably represents an aliphatic group having from 1 to 22 carbon atoms, which may be substituted. Practical examples thereof are the same as the preferred examples of $R^0$ in the aforesaid formula (M-I).

Furthermore, it is preferred that in the formula (M-Ia), the total atomic number of each atomic group of $V^0$, $A^1$, $B^1$, $A^2$, $B^2$, and $R^1$ is at least 8.

The recurring unit shown by the formula (M-Ia) is further described practically although the scope of this invention is not limited thereto.

In the following chemical formulae, a represents —H or —$CH_3$, R represents an alkyl group having from 1 to 18 carbon atoms, R′ represents a hydrogen atom or an alkyl group having from 1 to 18 carbon atoms, $k_1$ and $k_2$ each represents an integer of from 1 to 12, and $l_1$ represents an integer of from 1 to 100.

(A)-1

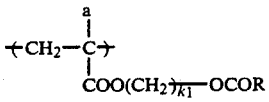

(A)-2

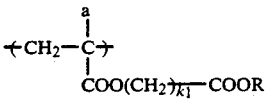

(A)-3

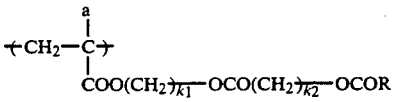

(A)-4

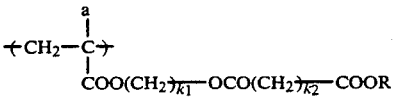

(A)-5

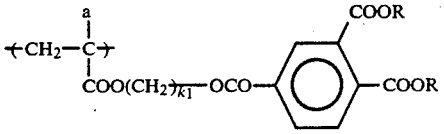

(A)-6

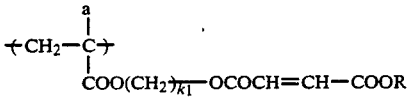

(A)-7

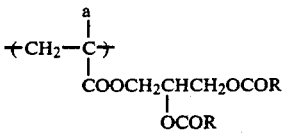

(A)-8

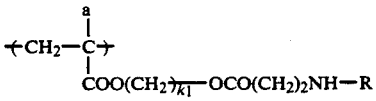

(A)-9

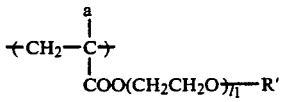

(A)-10

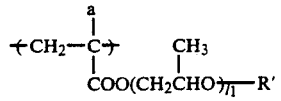

(A)-11

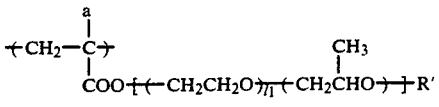

-continued (A)-12

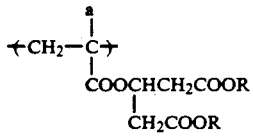

(A)-13

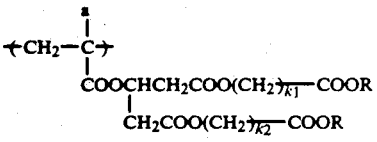

(A)-14

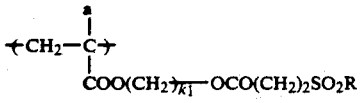

(A)-15

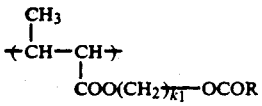

(A)-16

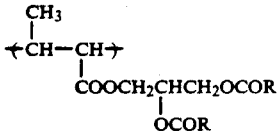

(A)-17

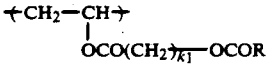

(A)-18

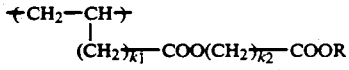

The macromonomer (M) for use in this invention has the aforesaid chemical structure that the polymerizable double bond group shown by the formula (M-II) bonded to only one terminal of the polymer main chain composed of the recurring unit shown by the formula (M-I) directly or via an optional linkage group.

In the formula (M-II), $V^1$ has the same meaning as $V^0$ in the formula (M-I); $c^1$ and $c^2$, which may be the same or different, each has the same meaning as $b^1$ or $b^2$ in the aforesaid formula (M-I).

Also, $V^1$, $c^1$, and $c^2$ are preferably the same as those described above for $V^0$, $b^1$, and $b^2$ in the formula (M-I). It is more preferred that one of $c^1$ and $c^2$ in the formula (M-II) is a hydrogen atom.

The linkage group which links the moiety shown by the formula (M-I) and the moiety shown by the formula (M-II) is composed of an optional combination of the atomic group of a carbon-carbon bond (single bond or double bond), a carbon-hetero atom bond (examples of the hetero atom are oxygen atom, sulfur atom, nitrogen atom, and silica atom), and a hetero atom-hetero atom bond.

Preferred examples of the macromonomer (M) used in this invention are those shown by the following formulae (M-VI) and (M-VIa):

(M-VI)

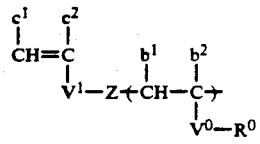

-continued (M-VIa)

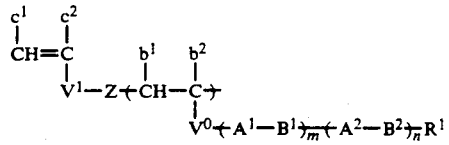

In the formulae (M-VI) and (M-VIa), symbols other than Z are the same as the symbols in the aforesaid formula (M-I), (M-Ia) and (M-II) and Z represents a simple bond, or a linkage group selected from the atomic groups of

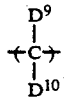

(wherein $D^9$ and $D^{10}$ each represents a hydrogen atom, a halogen atom (e.g., fluorine, chlorine, and bromine), a cyano group, a hydroxy group, or an alkyl group (e.g., methyl, ethyl, and propyl),

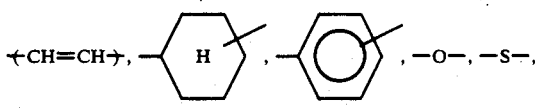

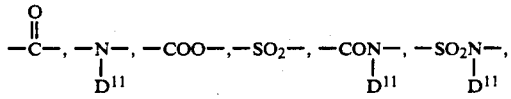

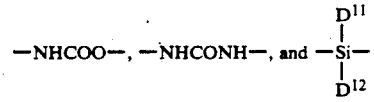

(wherein $D^{11}$ and $D^{12}$ each represents a hydrogen atom or the hydrocarbon group as described above on $D^1$) or a linkage group constituted by an optional combination of these atomic groups.

Particularly preferred examples of $b^1$, $b^2$, $c^1$, $c^2$, $V^0$, and $V^1$ in the formulae (M-VI) and (M-VIa) are shown below.

That is, $V^0$ is —COO—, —OCO—, —O—, —$CH_2COO$—, or —$CH_2OCO$—; $V^1$ is the aforesaid ones (wherein $D^1$ is a hydrogen atom; and $b^1$, $b^2$, $c^1$, and $c^2$ are a hydrogen atom or a methyl group.

Then, specific examples of

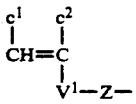

shown in the formulae (M VI) and (M-VIa) are shown below, though the present invention is not limited thereto.

In the following chemical formulae, b represents —H or —$CH_3$, $m_1$ represents an integer of from 1 to 12, and $n_1$ represents an integer of 2 to 12.

(B)-1
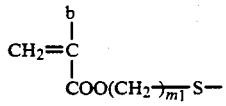
(B)-2
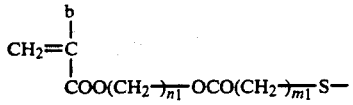
(B)-3
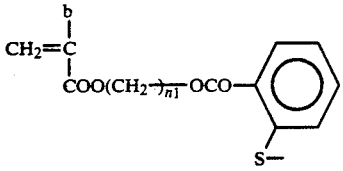
(B)-4
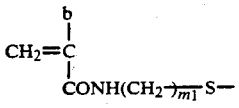
(B)-5
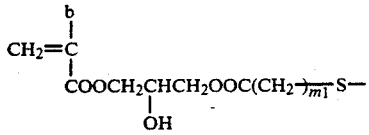
(B)-6
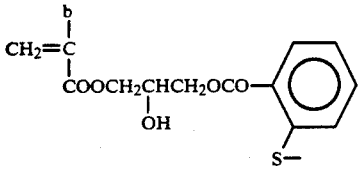
(B)-7
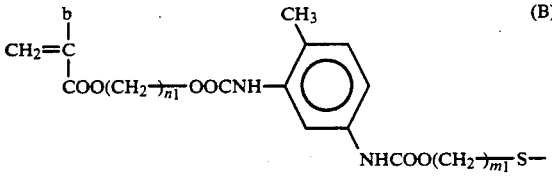
(B)-8
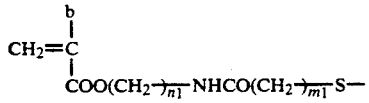
(B)-9
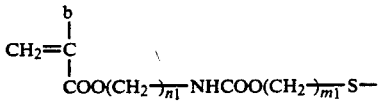
(B)-10
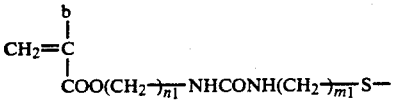
(B)-11
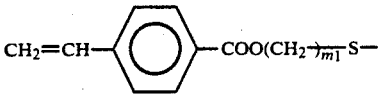
(B)-12
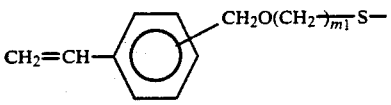
-continued
(B)-13
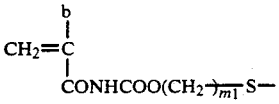
(B)-14
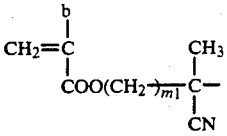
(B)-15
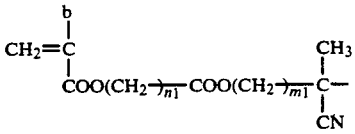
(B)-16
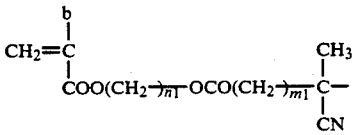
(B)-17
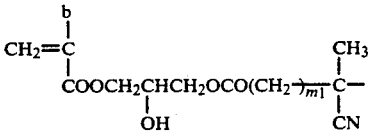
(B)-18
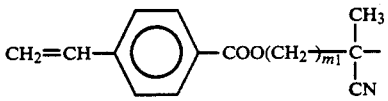
(B)-19
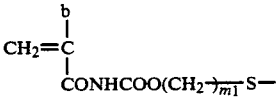
(B)-20
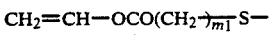
(B)-21
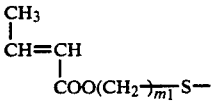
(B)-22
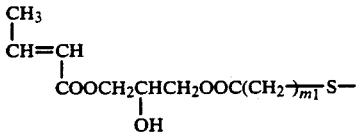
(B)-23
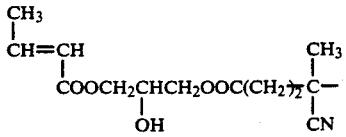
(B)-24
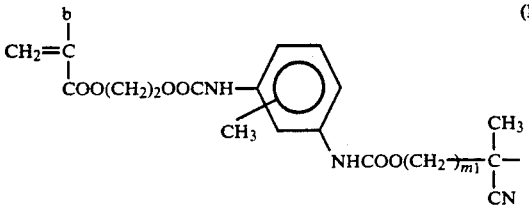

-continued

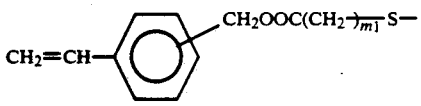

(B)-25

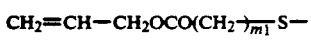

(B)-26

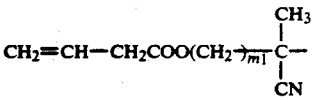

(B)-27

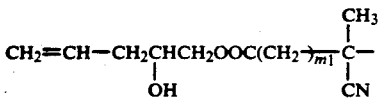

(B)-28

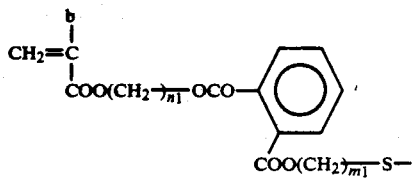

(B)-29

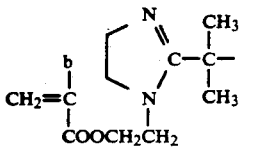

(B)-30

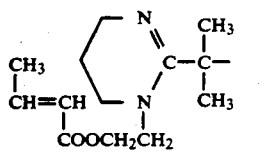

(B)-31

Also, the macromonomer (M) for use in this invention may contain other recurring unit together with the recurring unit shown by the formula (M-I) or (M-Ia) as a copolymer component. As such other copolymer components, a monomer capable of copolymerizing with the monomer corresponding to the recurring unit shown by the formula (M-I) can be used in this invention. Examples thereof are unsaturated carboxylic acids such as acrylic acid, methacrylic acid, itaconic acid, crotonic acid, maleic acid, vinylacetic acid, 4-pentenoic acid, etc.; esters or amides of these unsaturated carboxylic acids; vinyl esters, or allyl esters of fatty acids having from 1 to 22 carbon atoms; vinyl ethers; styrene and styrene derivatives; and heterocyclic compounds having an unsaturated bonding group. Practically, there are the compounds illustrated above for the monomer (A).

It is preferred, the content of the recurring unit shown by the formula (M-I) or (M-Ia) is at least 40% by weight and more preferably from 60 to 100% by weight of the whole recurring units in the macromonomer (M).

If the content of the component shown by the formula (M-I) or (M-Ia) is less than 40% by weight, the mechanical strength of the imaged portions formed by the dispersion resin grains is not sufficiently retained, whereby the effect of improving the printing resistance is not obtained in the case of use for offset master plates.

The number average molecular weight of the macromonomer (M) in this invention is preferably from $1\times10^3$ to $1\times10^4$, and more preferably from $2\times10^3$ to $9\times10^3$.

If the upper limit of the number average molecular weight of the macromonomer (M) exceeds $1\times10^4$, the printing resistance is lowered. On the other hand, if the molecular weight is below the lower limit, there is a tendency of causing stains. Thus, it is preferred that the molecular weight is not less than $1\times10^3$.

The macromonomer (M) in this invention can be prepared by conventionally known synthesis methods.

For example, there are (1) a method by an ion polymerization method of forming the macromer by reacting various reagents to the terminal of a living polymer obtained by an anion polymerization or a cation polymerization, (2) a method by a radical polymerization method of forming the macromer by reacting an oligomer having a reactive group at the terminal obtained by a radical polymerization using a polymerization initiator and/or a chain transfer agent having a reactive group such as a carboxy group, a hydroxy group, an amino group, etc., in the molecule, and (3) a method by a polycondensation method of introducing a polymerizable double bond group into an oligomer obtained by a poly-addition or poly-condensation reaction in the same manner as the aforesaid radical polymerization method.

Practically, the macromonomer (M) can be prepared by the methods described in P. Dreyfuss & R. P. Quirk, *Encycl. Polym. Sci. Eng.*, 7, 551(1987), P. F. Rempp & E. Franta, *Adv. Polym. Sci.*, 58, 1(1984), V. Percec, *Appl. Polym. Sci.*, 285, 95(1984), R. Asami & M. Takari, *Makamol. Chem. Suppl.*, 12, 163(1985), P. Rempp. et al, *Makamol Chem. Suppl.*, 8, 3(1984), Yushi Kawakami, *Kagaku Kogyo* (*Chemical Industry*), 38, 56(1987), Yuya Yamashita, *Kobunshi* (*High Polymer*), 31, 988(1982), Shiro Kobayashi, ibid., 30, 625(1981), Toshinobu Higashimura, *Journal of Adhesive Society of Japan*, 18, 536(1982), Koichi Ito, *Kobunshi Kako* (*Polymer Processing*), 35, 262(1986), and Kishiro Higashi and Takashi Tsuda, *Kino Zairyo* (*Functional Materials*), 1987, No. 10, page 5 and the literature references, patents, etc., cited therein.

Examples of the polymerization initiator having the specific reactive group in the molecule are azobis compounds such as 4,4'-azobis(4-cyanovaleric acid), 4,4'-azobis(4-cyanovaleric acid chloride), 2,2'-azobis-(2-cyanopropanol), 2,2'-azobis(2-cyanopentanol), 2,2'-azobis[2 methyl-N-(2-hydroxyethyl)propioamide], 2,2'-azobis{2-methyl-N-[1,1-bis(hydroxymethyl)ethyl]-propioamide}, 2,2'-azobis{2-methyl-N-[1,1-bis(hydroxymethyl)-2-hydroxyethyl]propioamide}, 2,2'-azobis[2-(5-methyl-2-imiszolin-2-yl)propane], 2,2'-azobis[2-(4,5,6,7-tetrahydro-1H-1,3-diazepin-2-yl)propane], 2,2'-azobis[2-(3,4,5,6-tetrahydropyrimidin-2-yl)propane], 2,2'-azobis[2-(5-hydroxy-3,4,5,6-tetrapyrimidin-2-yl)propane], 2,2'-azobis{2-[1-(2-hydroxyethyl -2-imidazolin-2-yl]propane}, 2,2'-azobis[N-(2-hydroxyethyl)-2-methylpropionamidine], and 2,2'-azobis[N-(4-aminophenyl)-2-methylpropionamidine].

Also, examples of the chain transfer agent having the specific reactive group in the molecule are mercapto compounds having the reactive group or a substituent capable of being converted into the reactive group (e.g., thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)-carbamoyl]propionic acid, 3-[N-(2-mercaptoethyl-)amino]propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 3-mercapto-1,2-propanediol, 1-mercapto-2 propanol, 3-mercapto-2-butanol, mercaptophenol, 2-mercaptoethylamine, 2-mercaptoimidazole, and 2-mercapto-3-pyridinol) and iodized alkyl compounds having the reactive group or a substituent capable of being induced into the reactive group (e.g., iodoacetic acid, iodopropionic acid, 2-iodoethanol, 2-iodoethanesulfonic acid, and 3-iodopropanesulfonic acid).

In these compounds, the mercapto compounds are preferred.

The chain transfer agent or the polymerization initiator is used in an amount of preferably from 0.5 to 20 parts by weight, and more preferably from 1 to 10 parts by weight per 100 parts by weight of the monomer corresponding to the recurring unit shown by the formula (I) or (Ia).

The dispersion resin grains for use in this invention may be prepared by polymerizing the aforesaid dispersion-stabilizing resin, the monomer (A), and the macromonomer (M) described above in a non-aqueous solvent by heating in the presence of a polymerization initiator such as benzoyl peroxide, azobis-isobutyronitrile, butyllithium, etc.

Practically, the dispersion resin can be produced by (1) a method of adding the polymerization initiating agent to a solution composed of the dispersion stabilizing agent, the monomer (A), and the macromonomer (M), (2) a method of adding dropwise the monomer (A) and the macromonomer (M) together with a polymerization initiator to a solution of the dispersion stabilizing resin, (3) a method of optionally adding a part of a mixture of the monomer (A) and the macromonomer (M) together with a polymerization initiator to a solution containing a whole amount of the dispersion stabilizing resin and the remaining mixture of the monomer (A) and the macromonomer (M), or (4) a method of optionally adding a solution of the dispersion stabilizing resin, the monomer (A), and the macromonomer (M) together with a polymerization initiator to the non-aqueous solvent.

The total amount of the monomer (A) and the macromonomer (M) is from about 5 to 80 parts by weight, and preferably from 10 to 50 parts by weight to 100 parts by weight of the non-aqueous solvent.

The amount of the soluble resin which is the dispersion stabilizing resin for the liquid developer of this invention is from 1 to 100 parts by weight, and preferably from 5 to 50 parts by weight per 100 parts of the total amount of the monomers.

The amount of the polymerization initiator being used is typically from 0.1 to 5% by weight of the total amount of the monomers.

Also, the polymerization temperature is from about 50° to 180° C., and preferably 60° to 120° C. The reaction time is preferably from 1 to 15 hours.

When the above-described polar solvent such as alcohols, ketones, ethers, esters, etc., is used together with the non-aqueous solvent in the reaction or when the unreacted monomer (A) remains without being polymerization-granulated, it is preferred that the polar solvent or the unreacted monomer is distilled off by heating the reaction mixture to a temperature of higher than the boiling point of the polar solvent or the monomer, or is distilled off under reduced pressure.

The molecular weight of the dispersion resin in this invention is from $1\times10^3$ to $1\times10^6$, and preferably from $1\times10^4$ to $5\times10^5$.

The non-aqueous dispersion resin prepared as described above exists as fine grains having a uniform grain size distribution and, at the same time, shows a very stable dispersibility. In particular, even when the liquid developer containing the non-aqueous dispersion resin grains (or non-aqueous latex grains) is repeatedly used for a long period of time in a developing apparatus, the dispersibility of the resin grains in the developer is well maintained. Also, even when the developing speed is increased, the resin is easily re-dispersed in the liquid developer and no occurrence of stains by sticking of the resin grains to parts of the developing apparatus is observed under such high load conditions.

Also, when the resin grains are fixed by heating, a strong film is formed, which shows an excellent fixability of the dispersion resin grains.

In particular, the non-aqueous dispersion resin described in JP-A-62-151868 is resin grains obtained by copolymerizing a monomer being insolubilized by polymerization and a copolymerizable monomer having at least two ester bonds, etc., in the molecule and the resin grains have greatly improved dispersibility and printing resistance as compared to conventional resin grains. However, when these resin grains are used for printing plate making machines using an offset printing master plate of a large size (e.g., EPL-560 and EPL 820, made by Fuji Photo Film Co., Ltd.) or the processing speed of the printing plate making machine is increased, there remains a problem with respect to the dispersibility of the resin grains.

On the other hand, with the resin grains in this invention, no such problem occurs even under such a severe condition.

As described above, the liquid developer of this invention is excellent in the dispersion stability, redispersibility, and fixability even in the case of quickening the development-fix steps and using master plates of a large size.

For the liquid developer of this invention may be used, if desired, coloring agents. There is no particular restriction on the coloring agents and conventional various pigments or dyes can be used.

When the dispersion resin itself is to be colored, a pigment or a dye is physically dispersed in the dispersion resin as one method, and various kinds of pigments and dyes are known, which can be used in the method. Examples of the coloring agent are a magnetic iron powder, a lead iodine powder, carbon black, nigrosine, alkali blue, hansa yellow, quinacridone red, and phthalocyanine blue.

As another method of coloring the liquid developer, the dispersion resin may be dyed with a desired dye, for example, as disclosed in JP-A-57-48738. As still other methods, the dispersion resin may be chemically bonded to a dye, for example, as disclosed in JP-A-53-54029; or a previously dye containing monomer is used in polymerizing granulation to obtain a dye-containing polymer, for example, as disclosed in JP-B-44-22955. (The term "JP-B" as used herein means an "examined Japanese patent publication".)

Various additives may be added to the liquid developer of the present invention so as to enhance the charging characteristic or to improve the image-forming characteristic. For example, the substances described in Y. Harasaki, *Electrophotography*, Vol. 16, No. 2, page 44 can be used for such purpose.

Specifically, useful additives include metal salts of di-2-ethylhexylsulfosuccinic acid, metal salts of naphthenic acid, metal salts of higher fatty acids, lecithin, poly(vinylpyrrolidone) and copolymers containing half-maleic acid amide component.

The amounts of the main constituting components of the liquid developer of the present invention are further explained below.

The amount of the toner grains consisting essentially of a resin and a colorant is preferably from about 0.5 to about 50 parts by weight per 1000 parts by weight of the liquid carrier. If it is less than about 0.5 part by weight, the image density would be insufficient. However, if it is more than about 50 pats by weight, the non-image area would thereby be fogged. In addition, the above-mentioned liquid carrier-soluble resin for enhancing the dispersion stability ma also be used, if desired, and it may be added in an amount of from about 0.5 part by weight to about 100 parts by weight, to 1000 parts by weight of the liquid carrier. The above-mentioned charge-adjusting agent is preferably used in an amount of from about 0.001 to about 1.0 part by weight per 1000 parts by weight of the liquid carrier. In addition, various additives may also be added to the liquid developer of the present invention, if desired, and the upper limit of the total amount of the additives is to be defined in accordance with the electric resistance of the liquid developer. Specifically, if the electric resistance of the liquid developer, from which toner grains are removed, is lower than $10^9$ Ω cm, images with good continuous gradation could hardly be obtained. Accordingly, the amounts of the respective additives are required to be properly controlled within the said limitation.

The following examples are intended to illustrate the embodiments of this invention in greater detail, but not to limit the present invention in any way.

PRODUCTION EXAMPLE 1 OF DISPERSION STABILIZING RESIN: P-1

A mixture of 100 g of octadecyl methacrylate, 2.0 g of divinylbenzene, 150 g of toluene, and 50 g of isopropanol was heated to 80° C. with stirring in a nitrogen gas stream and, after adding thereto 5.0 g of 2,2'-azobis(-cyanovaleric acid) (A.C.V), the reaction was carried out for 8 hours. After cooling, the reaction mixture was re-precipitated in 2 liters of methanol to form a white powder, which was collected by filtration and dried.

A mixture of 50 g of the white powder thus obtained, none, 0.5 g of N,N-dimethyldodecylamine, and 100 g of toluene was heated to 100° C. and stirred for 20 hours. The reaction mixture was re-precipitated in 1 liter of methanol to provide a light yellow powder, which was collected by filtration and dried. The amount of the product was 43 g and the weight average molecular weight thereof was $9.5\times10^4$.

PRODUCTION EXAMPLES 2 TO 10 OF DISPERSION STABILIZING RESIN: P-2 TO P-10

By following the same procedure as Production Example 1 described above except that each of the monomers shown in Table 1 below was used in place of octadecyl methacrylate, each of dispersion stabilizing resins P-2 to P-10 was produced. The weight average molecular weights of the resins thus obtained were from $9.0\times10^4$ to $10.5\times10^4$.

TABLE 1

| Production Example | Dispersion Stabilizing Resin | Monomer | |
|---|---|---|---|
| 2 | P-2 | Dodecyl Methacrylate | 100 g |
| 3 | P-3 | Tridecyl Methacrylate | 100 g |
| 4 | P-4 | Octyl Methacrylate | 50 g |
| | | Dodecyl Methacrylate | 50 g |
| 5 | P-5 | Octadecyl Methacrylate | 80 g |
| | | Butyl Methacrylate | 20 g |
| 6 | P-6 | Dodecyl Methacrylate | 92 g |
| | | N,N-dimethylaminoethyl Methacrylate | 8 g |
| 7 | P-7 | Octadecyl Methacrylate | 95 g |
| | | 2-(Trimethoxysilyloxy)-ethyl Methacrylate | 5 g |
| 8 | P-8 | Hexadecyl Methacrylate | 100 g |
| 9 | P-9 | Tetradecyl Methacrylate | 100 g |
| 10 | P-10 | Docosanyl Methacrylate | 100 g |

PRODUCTION EXAMPLES 11 TO 23 OF DISPERSION STABILIZING RESIN: P-11 TO P-23

By following the same procedure as Production Example 1 except that each of the polyfunctional monomers and the oligomers shown in Table 2 below was used in place of 2.0 g of divinyl benzene as a crosslinking polyfunctional monomer, each of dispersion stabilizing resins P-11 to P-23 shown in Table 2 was produced. The compound ISP-22GA used in Preparation Example 17 has the following formula:

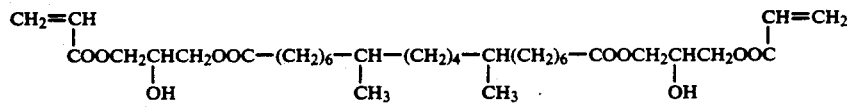

8.0 g of allyl glycidyl ether, 0.5 g of t-butylhydroqui-

TABLE 2

| Production Example | Dispersion Stabilizing Resin | Crosslinking Monomer or Oligomer | Amount (g) | Weight Average Molecular Weight |
|---|---|---|---|---|
| 11 | P-11 | Ethylene Glycol Dimethacrylate | 2.5 | $10.5\times10^4$ |
| 12 | P-12 | Diethylene Glycol Dimethacrylate | 2.5 | $10\times10^4$ |
| 13 | P-13 | Vinyl Methacrylate | 5 | $9.8\times10^4$ |
| 14 | P-14 | Isopropenyl Methacrylate | 8 | $8.6\times10^4$ |
| 15 | P-15 | Divinyl Adipate | 10 | $8.8\times10^4$ |
| 16 | P-16 | Diallyl Glutaconate | 10 | $9.5\times10^4$ |
| 17 | P-17 | ISP-22GA (trade name, made by Okamura Seiyu K.K.) | 3.0 | $10\times10^4$ |
| 18 | P-18 | Triethylene Glycol Diacrylate | 1.0 | $9.3\times10^4$ |
| 19 | P-19 | Trivinylbenzene | 0.8 | $11.2\times10^4$ |
| 20 | P-20 | Polyethylene Glycol #400 Diacrylate | 3.0 | $9.6\times10^4$ |
| 21 | P-21 | Polyethylene Glycol Dimethacrylate | 3.5 | $10.5\times10^4$ |

TABLE 2-continued

| Production Example | Dispersion Stabilizing Resin | Crosslinking Monomer or Oligomer | Amount (g) | Weight Average Molecular Weight |
|---|---|---|---|---|
| 22 | P-22 | Trimethylolpropane Triacrylate | 2.0 | $12 \times 10^4$ |
| 23 | P-23 | Polyethylene Glycol #600 Diacrylate | 3.0 | $9.5 \times 10^4$ |

PRODUCTION EXAMPLE 24 OF DISPERSION STABILIZING RESIN: P-24

A mixture of 100 g of octadecyl methacrylate, 3 g of thiomalic acid, 4.5 g of divinylbenzene, 150 g of toluene, and 50 g of ethanol was heated to 60° C. under a nitrogen gas stream and, after adding thereto 0.5 g of 2,2'-azobis(isobutyronitrile) (A.I.B.N), the reaction was carried out for 5 hours. Then, 0.3 g of A.I.B.N. was added to the reaction mixture and the reaction was further carried out for 3 hours. Further, 0.2 g of A.I.B.N. was added thereto and the reaction was carried out for 3 hours. After cooling, the reaction mixture was re-precipitated in 2 liters of methanol to form a white powder, which was collected by filtration and dried. The amount of the product was 85 g.

Then, a mixture of 50 g of the powder thus obtained and 100 g of toluene was heated to 40° C. and stirred to dissolve the powder. Then, after adding thereto 0.2 g of t-butylhydroquinone, 8 g of vinyl acetate, and 0.03 g of mercury acetate, the reaction was carried out for 2 hours. Then, the temperature of the reaction mixture was raised to 70° C. and, after adding thereto $1.2 \times 10^{-3}$ ml of 100% sulfuric acid, the reaction was carried out for 18 hours. After the reaction was over, 3.6 of sodium acetate trihydrate was added to the reaction mixture followed by stirring for 30 minutes and after cooling, the reaction mixture was re-precipitated in 1.5 liters of methanol to provide 41 g of a slightly brownish powder. The weight average molecular weight of the powder was $10.5 \times 10^4$.

PRODUCTION EXAMPLES 25 TO 30 OF DISPERSION STABILIZING RESINS: P-25 TO P-30

By following the same procedure as Production Example 24 described above except that each of the mercapto compounds shown in Table 3 below was used in place of 3 g of thiomalic acid, each of dispersion stabilizing resins P-25 to P-30 was produced. The weight average molecular weight of each of the resins obtained was also shown in Table 3.

TABLE 3

| Production Example | Dispersion Stabilizing Resin | Mercapto Compound | | Weight Average Molecular Weight |
|---|---|---|---|---|
| 25 | P-25 | $HSCH_2COOH$ | 2.5 g | $8.8 \times 10^4$ |
| 26 | P-26 | 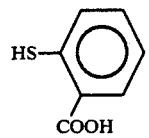 | 3.0 g | $9.5 \times 10^4$ |
| 27 | P-27 | $HSCH_2CH_2NH(CH_2)_2COOH$ | 3.5 g | $8.5 \times 10^4$ |
| 28 | P-28 | $HSCH_2CH_2NHCO(CH_2)_2COOH$ | 4.0 g | $9.0 \times 10^4$ |
| 29 | P-29 | $HSCH_2CH_2OOC(CH_2)_2COOH$ | 4.0 g | $9.5 \times 10^4$ |
| 30 | P-30 | $HSCH_2CH_2OOC{-}CH{=}CH{-}COOH$ | 4.0 g | $10 \times 10^4$ |

PRODUCTION EXAMPLE 31 OF DISPERSION STABILIZING RESIN: P-31

By following the same procedure as Production Example 24 except that a mixture of 100 g of dodecyl methacrylate, 4 g of ethylene glycol methacrylate, 4 g of thioglycolic acid 2,3-epoxypropyl ester, and 200 g of toluene was used in place of the mixture used in the example, the polymerization reaction was carried out.

Then, 6 g of crotonic acid, 1.0 g of 2,2'-methylenebis-(6-t-butyl-p-cresol), and 0.8 g of N,N-dimethyldodecylamine were added to the reaction mixture, and the reaction was further carried out for 20 hours with stirring at 100° C. The reaction mixture obtained was re-precipitated in 2 liters of methanol and a light yellow viscous product obtained was collected by a decantation method and dried. The amount of the product was 75 g and the weight average molecular weight thereof was $6.5 \times 10^4$.

PRODUCTION EXAMPLES 32 TO 40 OF DISPERSION STABILIZING RESINS: P-32 TO P-40

By following the same procedure as the Production Example 31 described above, except that each of the methacrylates and each of the carboxylic acid compounds having a polymerizable double bond group shown in Table 4 below were used in place of 100 g of dodecyl methacrylate and 6 g of crotonic acid, respectively, each of dispersion stabilizing resins P-32 to P-40 was produced.

The weight average molecular weights of the resins thus obtained were from $6.0 \times 10^4$ to $7.5 \times 10^4$.

TABLE 4

| Production Example | Dispersion Stabilizing Resin | Methacrylate | | Carboxylic Acid | |
|---|---|---|---|---|---|
| 32 | P-32 | Octadecyl Methacrylate | 100 g | Crotonic Acid | 6 g |

TABLE 4-continued

| Production Example | Dispersion Stabilizing Resin | Methacrylate | | Carboxylic Acid | |
|---|---|---|---|---|---|
| 33 | P-33 | Dodecyl Methacrylate | 100 g | Methacrylic Acid | 6 g |
| 34 | P-34 | Hexadecyl Methacrylate | 100 g | Acrylic Acid | 5 g |
| 35 | P-35 | Octadecyl Methacrylate | 100 g | 4-Vinylbenzoic Acid | 7 g |
| 36 | P-36 | Dodecyl Methacrylate | 95 g | 4-Pentenoic Acid | 6 g |
| | | 2-Hydroxyethyl Methacrylate | 5 g | | |
| 37 | P-37 | Tridecyl Methacrylate | 95 g | 3-Butenoic Acid | 5.5 g |
| | | 3-Chloropropyl Methacrylate | 5 g | | |
| 38 | P-38 | Dodecyl Methacrylate | 90 g | $CH_2=C(CH_3)COO(CH_2)_{10}COOH$ | 7 g |
| | | 2,4,6-Trifluorophenyl Methacrylate | 10 g | | |
| 39 | P-39 | Docosanyl Methacrylate | 100 g | $CH_2=C(CH_3)CONH(CH_2)_{10}COOH$ | 7.5 g |
| 40 | P-40 | Tetradecyl Methacrylate | 100 g | 3-Butenoic Acid | 5.8 g |

PRODUCTION EXAMPLE 41 OF DISPERSION STABILIZING RESIN: P-41

A mixture of 100 g of tridecyl methacrylate, 1.2 g of divinylbenzene, and 200 g of tetrahydrofuran was heated to 70° C. with stirring under nitrogen gas stream and, after adding thereto 6 g of 4,4'-azobis(4-cyanopentanol), the reaction was carried out for 8 hours. Then, after cooling the reaction mixture, 6.2 g of methacrylic anhydride, 0.8 g of t-butylhydroquinone, and one drop of concentrated sulfuric acid were added thereto, and the mixture was stirred for one hour at 30° C. and further stirred for 3 hours at 50° C. After cooling, the reaction mixture thus obtained was re-precipitated in 2 liters of methanol and, after removing the solution by decantation, a brownish viscous product thus formed was collected by filtration and dried. The amount of the product was 88 g and the weight average molecular weight thereof was $11.3\times10^4$.

PRODUCTION EXAMPLE 42 OF DISPERSION STABILIZING RESIN: P-42

A mixture of 100 g of octadecyl methacrylate, 1.1 g of ethylene glycol diacrylate, and 200 g of tetrahydrofuran was heated to 70° C. with stirring under a nitrogen gas stream and, after adding thereto 5 g of 4,4'-azobis(4-cyanopentanol), the reaction was carried out for 5 hours. Furthermore, 1.0 g of the aforesaid azobis compound was added to the reaction mixture, and the reaction was further carried out for 5 hours. The resulting reaction mixture was cooled to 20° C. in a water bath and, after adding thereto 3.2 g of pyridine and 1.0 g of 2,2'-methylenebis-(6-t-butyl-p-cresol), the resulting mixture was stirred. Then, to the mixture was added dropwise 4.2 g of methacrylic acid chloride over a period of 30 minutes in such a manner that the reaction temperature was not over 25° C., and the mixture obtained was stirred for 4 hours at temperature of from 20° to 25° C. Then, the reaction mixture was re-precipitated in a mixture of 1.5 liter of methanol and 0.5 liter of water to obtain a white powder, which was collected by filtration and dried. The amount of the product was 82 g and the weight average molecular weight thereof was $11.2\times10^4$.

PRODUCTION EXAMPLES 43 TO 51 OF DISPERSION STABILIZING RESINS: P-43 TO P-51

By following the same procedure as Production Example 42 except that each of the acid chlorides shown in Table 5 below was used in place of methacrylic acid chloride, each of dispersion stabilizing resins P-32 to P-51 was produced. The weight average molecular weights of the resins obtained were from $10\times10^4$ to $20\times10^4$.

TABLE 5

| Production Example | Dispersion Stabilizing Resis | Acid Chloride |
|---|---|---|
| 43 | P-43 | $CH_2=CH-COCl$ |
| 44 | P-44 | $CH_3-CH=CH-COCl$ |
| 45 | P-45 | 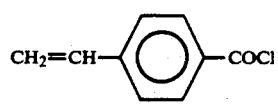 |
| 46 | P-46 | $CH_2=CH-COOCH_2CH_2COCl$ |
| 47 | P-47 | $CH_2=C(CH_3)-COO(CH_2)_2OCO(CH_2)_2COCl$ |
| 48 | P-48 | $CH_2=C(CH_3)-CONH(CH_2)_2COCl$ |
| 49 | P-49 | 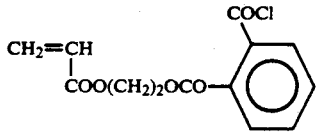 |
| 50 | P-50 | $CH_2=C(CH_3)-COOCH_2CH(Cl)CH_2OCO(CH_2)_3COCl$ |

TABLE 5-continued

| Production Example | Dispersion Stabilizing Resis | Acid Chloride |
|---|---|---|
| 51 | P-51 | $CH_2=C(CH_2COOCH_3)(COCl)$ |

PRODUCTION EXAMPLE 52 OF DISPERSION STABILIZING RESIN: P-52

A mixture of 100 g of dodecyl methacrylate, 0.8 g of ethylene glycol methacrylate, and 200 g of tetrahydrofuran was heated to 65° C. under nitrogen gas stream and, after adding thereto 4 g of 2,2'-azobis(4-cyanovaleric acid chloride), the mixture was stirred for 10 hours. The reaction mixture obtained was cooled below 25° C. in a water bath, and 2.4 g of allyl alcohol was added thereto. Then, 2.5 g of pyridine was added dropwise to the mixture in such a manner that the reaction temperature was not over 25° C. and the resulting mixture was stirred for one hour as it was. Furthermore, after stirring the mixture for 2 hours at 40° C., the reaction mixture was re-precipitated in 2 liters of methanol, and a light yellow viscous product was obtained by decantation and dried. The amount of the product was 80 g and the weight average molecular weight thereof was $10.5\times10^4$.

PRODUCTION EXAMPLES 53 TO 61 OF DISPERSION STABILIZING RESINS: P-53 TO P-61

By following the same procedure as Production Example 24 described above except that each of the methacrylates and each of the polyfunctional monomers shown in Table 6 below were used in place of octedecyl methacrylate and divinylbenzene used in the example, respectively, each of dispersion stabilizing resins P-53 to P-61 was produced. The weight average molecular weights of the resins thus obtained were from $9.0\times10^4$ to $12\times10^4$.

TABLE 6

| Production Example | Dispersion Stabilizing Resin | Methacrylate | | Polyfunctional Monomer | |
|---|---|---|---|---|---|
| 55 | P-53 | Dodecyl Methacrylate | 100 g | Divinylbenzene | 4 g |
| 54 | P-54 | Tridecyl Methacrylate | 100 g | Divinylbenzene | 4 g |
| 55 | P-55 | Dodecyl Methacrylate | 100 g | Trivinylbenzene | 1.3 g |
| 56 | P-56 | Octadecyl Methacrylate | 100 g | Ethylene Glycol Dimethacrylate | 5 g |
| 57 | P-57 | Hexadecyl Methacrylate | 100 g | Propylene Glycol Dimethacrylate | 5 g |
| 58 | P-58 | Dodecyl Methacrylate | 70 g | Divinylbenzene | 4 g |
| | | Octadecyl Acrylate | 30 g | | |
| 59 | P-59 | Octadecyl Methacrylate | 90 g | Ethylene Glycol Diacrylate | 4 g |
| | | Dodecyl Acrylate | 10 g | | |
| 60 | P-60 | Tridecyl Methacrylate | 94 g | Trimethylopropane Trimethyacrylate | 1.5 g |
| | | 2-Chloroethyl Methacrylate | 6 g | | |
| 61 | P-61 | Tetradecyl Methacrylate | 90 g | Divinylbenzene | 4 g |
| | | Styrene | 10 g | | |

PRODUCTION EXAMPLE 62 OF DISPERSION STABILIZING RESIN: P-62

A mixture of 97 g of octadecyl methacrylate, 3 g of thioglycolic acid, 6 g of divinylbenzene, and 200 g of toluene was heated to 85° C. with stirring under nitrogen gas stream and after adding thereto 1.0 g of 2,2'-azobis(cyclohexylcyanamide) (A.B.C.C.), the reaction was carried out for 5 hours. Furthermore, 0.6 g of A.B.C.C. was added thereto and the reaction was further carried out for 4 hours. After cooling the reaction mixture to 25° C., 6 g of allyl alcohol was added to the reaction mixture, and, after adding thereto dropwise a mixture of 8 g of dicyclohexylcarbodiimide (D.C.C.), 0.4 g of 4-(N,N-dimethylamino)pyridine (D.M.A.P.), and 10 g of methylene chloride over a period of 30 minutes, the reaction was carried out for 4 hours. Insoluble materials were removed by filtration, and the filtrate was re-precipitated from 3 liters of methanol to form white precipitates, which were then collected by filtration and dried. The amount of the product was 66 g and the weight average molecular weight was $3.6\times10^4$.

PRODUCTION EXAMPLE 63 OF DISPERSION STABILIZING RESIN: P-63

A mixture of 96 g of hexadecyl methacrylate, 4 g of 2-mercaptoethanol, 7 g of divinylbenzene, 160 g of toluene, and 40 g of ethanol was heated to 80° C. with stirring under nitrogen gas stream and, after adding thereto 2 g of A.I.B.N., the reaction was carried out for 4 hours. Furthermore, 1.0 g of A.I.B.N. was added to the reaction mixture and the reaction was further carried out for 4 hours. The reaction mixture was re-precipitated in 3 liters of methanol to form precipitates, which were then collected by filtration and dried. The yield of the product was 78 g.

A mixture of 50 g of the aforesaid reaction product, 5 g of 4-pentenoic acid, and 150 g of tetrahydrofuran was stirred at 25° C. to dissolve the product. Then, a mixture of 6 g of D.C.C., 0.3 g of D.M.A.P., and 10 g of methylene chloride was added dropwise to the reaction mixture over a period of 30 minutes, and the mixture was stirred for 5 hours.

After adding thereto 10 g of water followed by stirring for one hour, the precipitates thus formed were removed by filtration, and the filtrate obtained was re-precipitated to form precipitates, which were collected by filtration and dried. The yield of the product was 38 g and the weight average molecular weight of the product was $4.0\times10^4$.

PRODUCTION EXAMPLE 1 OF MACROMONOMER: M-1

A mixture of 92 g of methyl methacrylate, 5 g of thioglycolic acid, and 200 g of toluene was heated to 75° C. with stirring under nitrogen gas stream and, after adding thereto 31 g of 2,2'-azobis(cyanovaleric acid) (A.C.V.), the reaction was carried out for 8 hours. Then, after adding thereto 8 g of glycidyl methacrylate, 1.0 g of N,N-dimethyldodecylamine, and 0.5 g of t-butylhydroquinone, the resulting mixture was stirred for 12 hours at 100° C. After cooling, the reaction mixture was re-precipitated from 2 liters of methanol to form a white powder, which was then collected by filtration to obtain 82 g of a white powder. The number average molecular weight of the polymer was 6,500.

PRODUCTION EXAMPLE 2 OF MACROMONOMER: M-2

A mixture of 95 g of methyl methacrylate, 5 g of thioglycolic acid, and 200 g of toluene was heated to 70° C. with stirring under nitrogen gas stream and, after adding thereto 1.5 g of 2,2'-azobis(isobutyronitrile) (A.I.B.N.), the reaction was carried out for 8 hours. Then, to the reaction mixture were added 7.5 g of glycidyl methacrylate, 1.0 g of N,N-dimethyldodecylamine, and 0.8 g of t-butylhydroquinone, and the resulting mixture was stirred for 12 hours at 100° C. After cooling, the reaction mixture was re-precipitated from 2 liters of methanol to obtain 85 g of a colorless transparent viscous product. The number average molecular weight of the polymer obtained was 2,400.

PRODUCTION EXAMPLE 3 OF MACROMONOMER: M-3

A mixture of 94 g of methyl methacrylate, 6 g of 2-mercaptoethanol, and 200 g of toluene was heated to 70° C. under a nitrogen gas stream and, after adding thereto 1.2 g of A.I.B.N., the reaction was carried out for 8 hours.

The reaction mixture was cooled to 20° C. in a water bath and, after adding thereto 10.2 g of triethylamine, 14.5 g of methacrylic acid chloride was added dropwise to the mixture with stirring at 25° C. Thereafter, the mixture was further stirred for one hour as it was. Then, 0.5 g of t-butylhydroquinone was added thereto, and the resulting mixture was stirred for 4 hours at 60° C. After cooling, the reaction mixture was re-precipitated from 2 liters of methanol to obtain 79 g of a colorless transparent viscous product. The number average molecular weight of the product was 4,500.

PRODUCTION EXAMPLE 4 OF MACROMONOMER: M-4

A mixture of 95 g of hexyl methacrylate and 200 g of toluene was heated to 70° C. under a nitrogen gas stream and, after adding thereto 5 g of 2,2'-azobis-(cyanoheptanol), the reaction was carried out for 8 hours.

After allowing the reaction mixture to cool, it was cooled to 20° C. in a water bath and, after adding thereto 1.0 g of triethylamine and 21 g of methacrylic acid anhydride, the resulting mixture was stirred for one hour and then stirred for 6 hours at 60° C.

After cooling, the reaction mixture obtained was re-precipitated from 2 liters of methanol to obtain 75 g of a colorless transparent viscous product. The number average molecular weight of the product was 6,200.

PRODUCTION EXAMPLE 5 OF MACROMONOMER: M-5

A mixture of 93 g of dodecyl methacrylate, 7 g of 3-mercaptopropionic acid, 170 g of toluene, and 30 g of isopropanol was heated to 70° C. under a nitrogen gas stream to provide a homogeneous solution. After adding thereto 2.0 g of A.I.B.N., the reaction was carried out for 8 hours. After cooling, the reaction mixture was re-precipitated from 2 liters of methanol, and the mixture was heated to 50° C. under reduced pressure to distill off the solvent. The viscous product obtained was dissolved in 200 g of toluene and 16 g of glycidyl methacrylate, 1.0 g of N,N-dimethyldodecyl methacrylate, and 1.0 g of t-butylhydroquinone were added to the solution, followed by stirring for 10 hours at 110° C. The reaction mixture was re-precipitated again from 2 liters of methanol to obtain a pale yellow viscous product. The number average molecular weight of the product was 3,400.

PRODUCTION EXAMPLE 6 OF MACROMONOMER: M-6

A mixture of 95 g of octadecyl methacrylate, 5 g of thioglycolic acid, and 200 g of toluene was heated to 75° C. with stirring under nitrogen gas stream and, after adding thereto 1.5 g of A.I.B.N., the reaction was carried out for 8 hours. Then, to the reaction mixture were added 13 g of glycidyl methacrylate, 1.0 g of N,N-dimethyldodecylamine, and 1.0 g of t-butylhydroquinone, and the resulting mixture was stirred for 10 hours at 110° C. After cooling, the reaction mixture was re-precipitated from 2 liters of methanol to obtain 86 g of a white powder. The number average molecular weight of the product was 2,300.

PRODUCTION EXAMPLE 7 OF MACROMONOMER: M-7

A mixture of 40 g of methyl methacrylate, 54 g of ethyl methacrylate, 6 g of 2-mercaptoethylamine, 150 g of toluene, and 50 g of tetrahydrofuran was heated to 75° C. with stirring under nitrogen gas stream and, after adding thereto 2.0 g of A.I.B.N., the reaction was carried out for 8 hours.

Then, the reaction mixture was cooled to 20° C. in a water bath and, after adding dropwise thereto 23 g of methacrylic acid anhydride in such a manner that the temperature was not over 25° C., the mixture was stirred for one hour as it was. Then, 0.5 g of 2,2'-methylenebis(6-t-butyl-p-cresol) was added thereto, and the mixture was stirred for 3 hours at 40° C. After cooling, the reaction mixture was re-precipitated from 2 liters of methanol to obtain 83 g of viscous product. The number average molecular weight of the product was 2,200.

PRODUCTION EXAMPLE 8 OF MACROMONOMER: M-8

A mixture of 95 g of methyl methacrylate and 200 g of toluene was heated to 75° C. under a nitrogen gas stream and, after adding thereto 5 g of A.C.V., the reaction was carried out for 8 hours. Then, 15 g of glycidyl acrylate, 1.0 g of N,N-dimethyldodecylamine, and 1.0 g of 2,2'-methylenebis(6-t-butyl-p-cresol) were added to the mixture, and the resulting mixture was stirred for 15 hours at 100° C. After cooling, the reaction mixture was re-precipitated from 2 liters of methanol to obtain 83 g of a transparent viscous product. The number average molecular weight of the product was 3,600.

PRODUCTION EXAMPLE 9 OF MACROMONOMER: M-9

A mixture of 96 g of 2-(n-hexylcarbonyloxy)ethyl methacrylate, 4 g of thioglycolic acid, and 200 g of toluene was heated to 70° C. with stirring under nitrogen gas stream, and, after adding thereto 1.0 g of 2,2'-azobis(isobutyronitrile) (A.I.B.N.), the reaction was carried out for 8 hours. Then, 8 g of glycidyl methacrylate, 1.0 g of N,N-dimethyldodecylamine, and 0.5 g of t-butylhydroquinone were added to the reaction mixture, and the resulting mixture was stirred for 12 hours at 100° C. After cooling, the reaction mixture was reprecipitated from 2 liters of methanol to obtain 82 g of an oily product. The number average molecular weight of the polymer obtained was 5,600.

Macromonomer M-9:

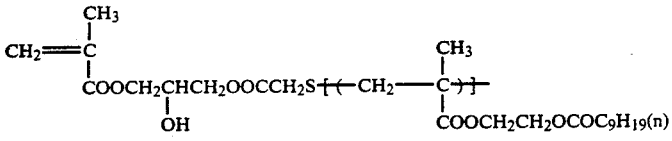

In the above formula as well as the formulae of macromonomers described below, the group represented by ⊣ ⊢ means a recurring unit.

EXAMPLES 10 TO 29 OF MACROMONOMER: M-10 TO M-29

By following the same procedure as Production Example 9 of macromonomer except that each of the compounds shown in Table 7 below was used in place of 2-(n-hexylcarbonyloxy)ethyl methacrylate only, each of the macromonomers having the following formula was produced. The number average molecular weights of the macromonomers thus obtained were in the range of from 5,000 to 7,000.

TABLE 7

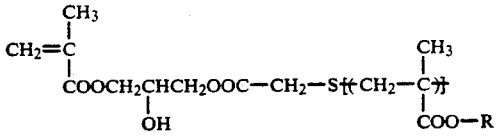

| Production Example of Macromonomer | Macro-monomer | —R |
|---|---|---|
| 10 | M-10 | $\leftarrow(CH_2)_2OCOCH_3$ |
| 11 | M-11 | $\leftarrow(CH_2)_2OCOC_4H_9$ |
| 12 | M-12 | $\leftarrow(CH_2)_2OCOC_{11}H_{23}$ |
| 13 | M-13 | $\leftarrow(CH_2)_2OCO(CH_2)_2COOC_2H_5$ |
| 14 | M-14 | $\leftarrow(CH_2)_2OCO(CH_2)_3COOCH_3$ |
| 15 | M-15 | $\leftarrow(CH_2)_2OCOCH{=}CH{-}COOC_5H_{11}$ |
| 16 | M-16 | $-CH_2CH(OH)CH_2OOCC_3H_7$ |
| 17 | M-17 | $-CH_2CH(OH)CH_2OOCC_5H_{11}$ |
| 18 | M-18 | $-CH_2CH(OCOCH_3)CH_2OCOCH_3$ |

TABLE 7-continued

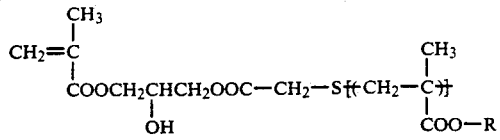

| Production Example of Macromonomer | Macro-monomer | —R |
|---|---|---|
| 19 | M-19 | $-CH_2CH(OCOC_3H_7)CH_2OCOC_3H_7$ |
| 20 | M-20 | $-CH_2CH(OCOC_5H_{11})CH_2OCOC_5H_{11}$ |
| 21 | M-21 | $-CH_2CH(OCOC_6H_{13})CH_2OCOC_6H_{13}$ |
| 22 | M-22 | $-CH_2CH(OCOCH_3)CH_2OCOC_5H_{11}$ |
| 23 | M-23 | $-CH_2CH(OH)CH_2OOC(CH_2)_2COOC_3H_7$ |
| 24 | M-24 | $-CH_2CH(OH)CH_2OOC(CH_2)_3COOCH_3$ |
| 25 | M-25 | $-CH_2CH(OCOCH_3)CH_2OOC(CH_2)_2COOC_3H_7$ |
| 26 | M-26 | $-CH(OCOCH_3)-CH_2COOCH_3$ |
| 27 | M-27 | $\leftarrow(CH_2)_2OCO(CH_2)_2SO_2C_4H_9$ |
| 28 | M-28 | $\leftarrow(CH_2)_2OCO(CH_2)_2SO_2C_8H_{17}$ |
| 29 | M-29 | $\leftarrow(CH_2)_6OCOC_2H_5$ |

PRODUCTION EXAMPLE 30 OF MACROMONOMER: M-30

A mixture of 96 g of 2,3-diacetoxypropyl methacrylate, 4 g of thioethanol, and 200 g of toluene was heated to 70° C. with stirring under nitrogen atom stream and after adding thereto 1.0 g of A.I.B.N., the reaction was carried out for 4 hours. Furthermore, after adding thereto 5.0 g of A.I.B.N., and the reaction was further carried out for 3 hours and, after further adding thereto 0.3 g of A.I.B.N., the reaction was carried out for 3 hours. The reaction mixture was cooled to room temperature and, after adding thereto 9.6 g of 2-carboxyethyl methacrylate, a mixture of 12.7 g of dicyclohexylcarbodiimide (D.C.C.) and 50 g of methylene chloride was added dropwise to the mixture. Then, 1.0 g of t-butylhydroquinone was added to the mixture followed by stirring for 4 hours. Crystals formed were removed by filtration and the filtrate obtained was re-precipitated in 2 liters of methanol. An oily product thus precipitated was collected by decantation, dissolved in 150 ml of methylene chloride, and the solution was re-precipitated again from one liter of methanol to obtain an oily product. The product was then collected by filtration and dried under reduced pressure to obtain 54 g of a polymer having a number average molecular weight.

Macromonomer M-30:

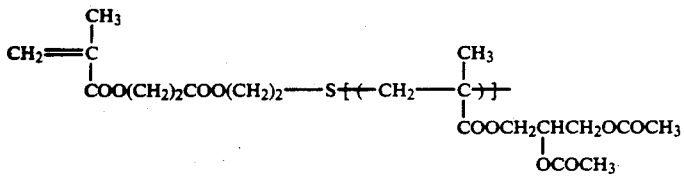

PRODUCTION EXAMPLES 31 TO 37 OF MACROMONOMER: M-31 TO M-37

By following the same procedure as Production Example 30 of macromonomer except that 2,3-diacetoxypropyl methacrylate and the unsaturated carboxylic acid (corresponding to 2-carboxyethyl methacrylate) in Example 30 were changed, each of the macromonomers shown in Table 8 below was produced. The number average molecular weights of the macromonomers thus obtained were in the range of from 3,000 to 6,000.

TABLE 8

| Production Example of Macromonomer | Macromonomer | Chemical Structure of Macromonomer |
|---|---|---|
| 31 | M-31 | 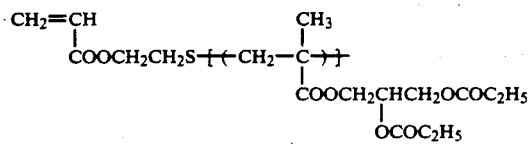 |
| 32 | M-32 | 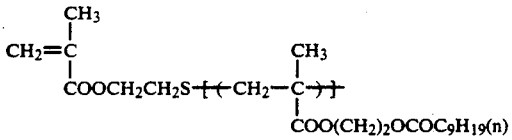 |
| 33 | M-33 | 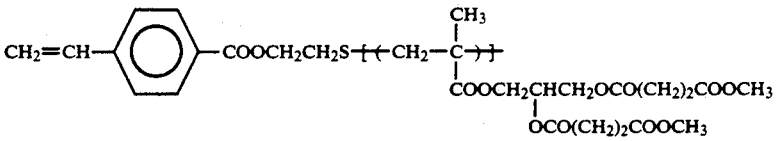 |
| 34 | M-34 | 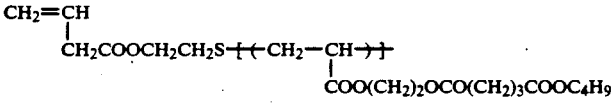 |
| 35 | M-35 | 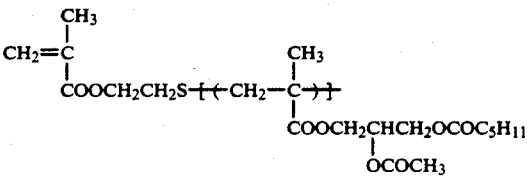 |
| 36 | M-36 | 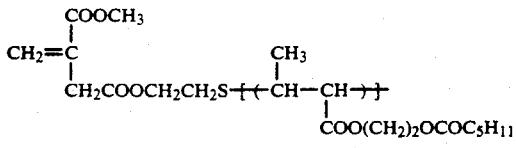 |

TABLE 8-continued

| Production Example of Macromonomer | Macromonomer | Chemical Structure of Macromonomer |
|---|---|---|
| 37 | M-37 | $CH_2{=}C(CH_3)-COO(CH_2)_2OCO(CH_2)_2COO(CH_2)_2S-[(CH_2-C(CH_3)(COOCH_2CH(OCOC_5H_{11})CH_2OCOC_5H_{11}))]$ |

PRODUCTION EXAMPLE 38 OF MACROMONOMER: M-38

A mixture of 96 g of 2-(3-methoxycarbonylpropylcarbonyloxy)ethyl methacrylate, 4 g of 2-mercaptoethylamine, and 200 g of tetrahydrofuran was heated to 70° C. under a nitrogen gas stream. Then, after adding thereto 1.0 g of A.I.B.N., the reaction was carried out for 4 hours and, after further adding thereto 0.5 g of A.I.B.N., the reaction was carried out for 4 hours. Then, the reaction mixture was cooled to 20° C. in a water bath, and, after adding thereto 6.3 g of triethylamine, 5.6 g of acrylic acid chloride was added dropwise to the mixture with stirring at a temperature below 25° C. Thereafter, the resulting mixture was stirred for one hour as it was. Then, after adding thereto 0.5 g of t-butylhydroquinone, the mixture was heated to 60° C., followed by stirring for 4 hours. After cooling the reaction mixture, the operation for re-precipitating the reaction mixture from 2 liters of methanol was carried out twice to obtain 54 g of a pale yellow viscous product. The number average molecular weight of the product was 4,300.

Macromonomer M-38:

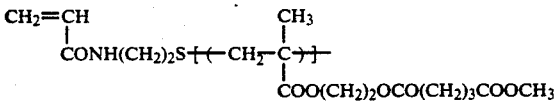

PRODUCTION EXAMPLE 39 OF MACROMONOMER: M-39

A mixture of 95 g of 2,3-dihydroxypropyl methacrylate, 150 g of tetrahydrofuran, and 50 g of isopropyl alcohol was heated to 75° C. under a nitrogen gas stream. Then, after adding thereto 4.0 g of 4,4'-azobis(4-cyanovaleric acid) (A.C.V.), the reaction was carried out for 5 hours, and, after further adding thereto 1.0 g of A.C.V., the reaction was carried out for 4 hours. After cooling, the reaction mixture was re-precipitated from 1.5 liters of water and, the oily product formed was collected by filtration and dried under reduced pressure. The amount of the product was 85 g.

To 50 g of the oily product (oligomer) were added 15 g of glycidyl methacrylate, 1.0 g of N,N-dimethyldodecylamine, and 1.0 g of 2,2'-methylenebis(6-t-butyl-p-cresol), and the mixture was stirred for 15 hours at 100° C. After cooling, the reaction mixture was re-precipitated from one liter of petroleum ether to obtain 36 g of a transparent viscous product. The number average molecular weight of the product was 3,600.

Macromonomer M-39:

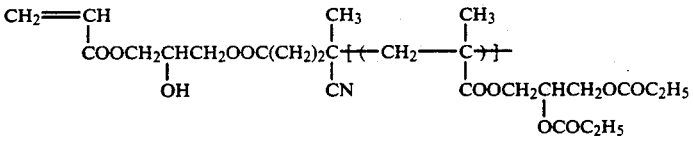

PRODUCTION EXAMPLE 40 OF MACROMONOMER: M-40

To a mixture of 50 g of the oligomer (oily product) obtained in Production Example 39 of macromonomer as an intermediate, 5.6 g of 2-hydroxymethyl methacrylate, and 100 g of methylene chloride was added dropwise a mixture of 9.0 g of D.C.C., 0.5 g of 4-dimethylaminopyridine, and 20 g of methylene chloride with stirring at room temperature over a period of one hour. The mixture was further stirred as it was. The precipitated crystals were filtered, and the operation for re-precipitating the filtrate obtained from one liter of petroleum ethanol was carried out twice and an oily product was dried under reduced pressure. The amount of the product was 28 g and the number average molecular weight was 3,000.

Macromonomer M-40:

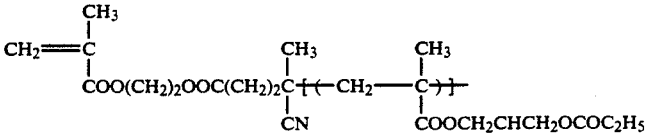

PRODUCTION EXAMPLE 41 OF MACROMONOMER: M-41

A mixture of 95 g of 2-(n-nonylcarbonyloxy)ethyl crotonate and 200 g of tetrahydrofuran was heated to 75° C. under a nitrogen gas stream and, after adding thereto 5 g of 2,2'-azobis(cyanobutanol), the reaction was carried out for 8 hours.

After cooling the reaction mixture to 20° C. in a water bath, 1.0 g of triethylamine and 21 g of methacrylic acid anhydride were added to the reaction mixture followed by stirring for one hour, and the mixture was further stirred for 6 hours at 60° C.

Then, after cooling the reaction mixture, an operation for re precipitating the reaction mixture in 2 liters of methanol was repeated twice to obtain 62 g of a colorless transparent viscous product. The number average molecular weight of the product was 6,200.

Macromonomer M-41:

-continued

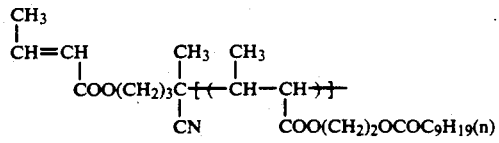

PRODUCTION EXAMPLES 42 TO 49 OF MACROMONOMER: M-42 TO M-49

By following the same procedure as Production Example 9 of macromonomer except that the methacrylate monomer (2-(n-hexylcarbonyloxy)ethyl methacrylate), the mercapto compound (thioglycolic acid), and the epoxy group containing monomer (glycidyl methacrylate) were changed, each of the macromonomers shown in Table 9 below was prepared.

TABLE 9

| Production Example of Macromonomer | Macro-monomer | Chemical Structure of Macromonomer | Number Average Molecular Weight |
|---|---|---|---|
| 42 | M-42 | 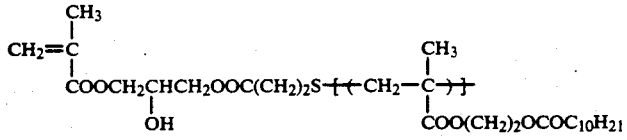 | 6,200 |
| 43 | M-43 | 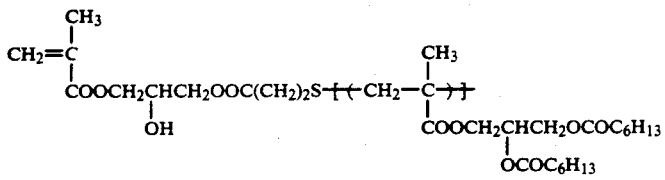 | 5,800 |
| 44 | M-44 | 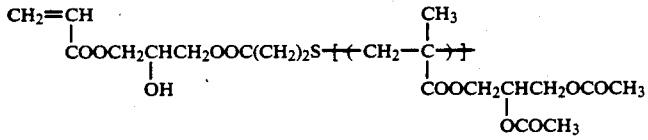 | 6,100 |
| 45 | M-45 | 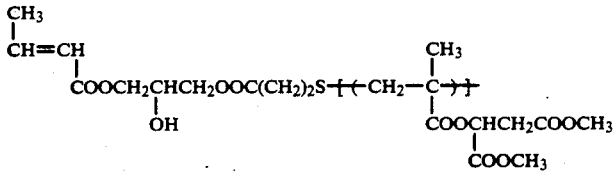 | 5,800 |
| 46 | M-46 | 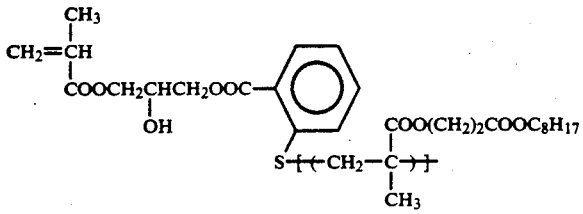 | 6,600 |
| 47 | M-47 | 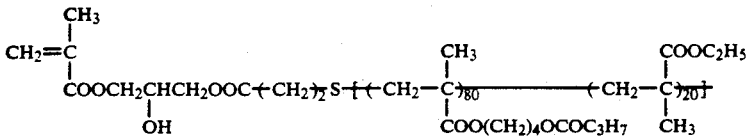 | 6,500 |

TABLE 9-continued

| Production Example of Macromonomer | Macro-monomer | Chemical Structure of Macromonomer | Number Average Molecular Weight |
|---|---|---|---|
| 48 | M-48 | $CH_2{=}C(CH_3)-COO(CH_2)_2OCO(CH_2)_2-COOCH_2CH(OH)CH_2-OOCCH_2S-[(CH_2-C(CH_3)(COO(CH_2CH_2O)_2CH_3))]-$ | 5,300 |
| 49 | M-49 | $CH_2{=}CH-COOCH_2CH(OH)CH_2OOC-(CH_2)_2CONH-(CH_2)_2S-[(CH-CH(COO(CH_2)_6COOC_5H_{11}(i))-)]-$ | 7,000 |

PRODUCTION EXAMPLE 1 OF LATEX GRAINS: LATEX D-1

A mixture of 12 g of the resin P-1 obtained in Production Example 1 of dispersion stabilizing resin, 100 g of vinyl acetate, 1.0 g of the macromonomer M-1 obtained in Production Example 1 of macromonomer, and 380 g of Isopar H was heated to 75° C. with stirring under nitrogen gas stream and, after adding thereto 1.7 g of A.I.B.N., the reaction was carried out for 6 hours. Twenty minutes after the addition of the polymerization initiator, the reaction mixture became white-turbid, and the reaction temperature raised to 88° C. The temperature of the system was raised to 100° C., and the reaction mixture was stirred for 2 hours to distil off unreacted vinyl acetate. After cooling, the reaction mixture was passed through a 200 mesh nylon cloth to provide a latex having a mean grain size of 0.20 μm with a polymerization ratio of 90% as a white dispersion.

PRODUCTION EXAMPLES 2 TO 11 OF LATEX GRAINS: D-2 TO D-11

By following the same procedure as Production Example 1 of latex grains except that the compounds shown in Table 10 below were used in place of the dispersion stabilizing resin P-1 and the macromonomer M-1, each of white dispersions was obtained with polymerization ratios of from 85 to 90%.

TABLE 10

| Production Example of Latex Grains | Latex Grains | Dispersion Stabilizing Resin | Macro-monomer | Mean Grain Size of Latex Grains (μm) |
|---|---|---|---|---|
| 2 | D-2 | P-2 | M-1 | 0.19 |
| 3 | D-3 | P-2 | M-3 | 0.22 |
| 4 | D-4 | P-2 | M-4 | 0.23 |
| 5 | D-5 | P-2 | M-5 | 0.20 |
| 6 | D-6 | P-2 | M-6 | 0.21 |
| 7 | D-7 | P-3 | M-1 | 0.18 |
| 8 | D-8 | P-4 | M-7 | 0.19 |
| 9 | D-9 | P-5 | M-8 | 0.20 |
| 10 | D-10 | P-8 | M-2 | 0.19 |
| 11 | D-11 | P-9 | M-1 | 0.20 |

PRODUCTION EXAMPLE 12 OF LATEX GRAINS: D-12

A mixture of 13 g of the resin P-2 obtained in Production Example 2 of dispersion stabilizing resin, 100 g of vinyl acetate, 5 g of crotonic acid, 1.0 g of the macromonomer M-1 obtained in Production Example 1 of macromonomer, and 468 g of Isopar E was heated to 70° C. with stirring under nitrogen gas stream and, after adding thereto 1.3 g of 2,2'-azobis(isovaleronitrile) (A.I.V.N.), the reaction was carried out for 6 hours. Thereafter, the temperature of the mixture was raised to 100° C., and the reaction mixture was stirred at the temperature for one hour to distill off remaining vinyl acetate. After cooling the reaction mixture was passed through a 200 mesh nylon to obtain a latex having a mean grain size of 0.25 μm with a polymerization ratio of 85 as a white dispersion.

PRODUCTION EXAMPLE 13 OF LATEX GRAINS: D-13

A mixture of 14 g of the resin P-1 obtained in Production Example 1 of dispersion stabilizing resin, 100 g of vinyl acetate, 6.0 g of 4-pentenoic acid, 1.5 g of the macromonomer M-7 obtained in Production Example 7 of macromonomer, and 380 g of Isopar G was heated to 75° C. with stirring under nitrogen gas stream. After adding thereto 0.7 g of A.I.B.N., the reaction was carried out for 4 hours and, after further adding thereto 0.5 g of A.I.B.N., the reaction was carried out for 2 hours. After cooling, the reaction mixture was passed through a 200 mesh nylon cloth to obtain a latex having a mean grain size of 0.26 μm as a white dispersion.

PRODUCTION EXAMPLE 14 OF LATEX GRAINS: D-14

A mixture of 14 g of the resin P-2 obtained in Production Example 2 of dispersion stabilizing resin, 85 g of vinyl acetate, 15 g of N-vinylpyrrolidone, 1.2 g of the macromonomer M-1 obtained in Production Example 1 of macromonomer, and 380 g of n-decane was heated to 75° C. with stirring under nitrogen gas stream. After adding thereto 1.7 g of A.I.B.N., the reaction was carried out for 4 hours and, after further adding thereto 0.5 g of A.I.B.N., the reaction was carried out for 2 hours. After cooling, the reaction mixture was passed through a 200 mesh nylon cloth to obtain a latex having a mean grain size of 0.23 μm as a white dispersion.

PRODUCTION EXAMPLE 15 OF LATEX GRAINS: D-15

A mixture of 18 g of the resin P-1 obtained in Production Example 1 of dispersion stabilizing resin, 100 g of methyl methacrylate, 1.5 g of the macromonomer M-2 obtained in Production Example 2 of macromonomer, 0.8 g of n-dodecylmercaptan, and 470 g of n-octane was heated to 70° C. with stirring under nitrogen gas stream and after adding thereto 1.0 g of A.I.V.N., the reaction was carried out for 2 hours. Few minutes after the addition of the polymerization initiator, the reaction mixture began to become blue turbid, and the reaction temperature raised to 90° C. After cooling, the reaction mixture was passed through a 200 mesh nylon cloth to remove coarse grains, whereby a latex having a mean grain size of about 0.27 μm was obtained as a white dispersion.

PRODUCTION EXAMPLE 16 OF LATEX GRAINS

Comparison Example A

By following the same procedure as Production Example 1 of latex grains except that the macromonomer M-1 was not used, a latex having a mean grain size of 0.20 was obtained with a polymerization ratio of 85% as a white dispersion.

PRODUCTION EXAMPLE 17 OF LATEX GRAINS

Comparison Example B

By following the same procedure as Production Example 1 of latex grains except that 1.0 g of octadecyl methacrylate was used in place of the macromonomer M-1, a latex having a mean grain size of 0.22 μm was obtained with a polymerization ratio of 85% as a white dispersion.

PRODUCTION EXAMPLE 18 OF LATEX GRAINS

Comparison Example C

By following the same procedure as Production Example 1 of latex grains except that 1 g of a monomer (I) having the structure shown below was used in place of the macromonomer M-1, a latex having a mean grain size of 0.22 μm was obtained with a polymerization ratio of 86% as a white dispersion.

Monomer (I):

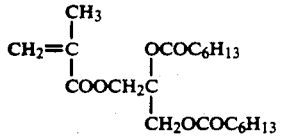

PRODUCTION EXAMPLE 19 OF LATEX GRAINS: D-16

A mixture of 8 g of the dispersion-stabilizing resin P-1, 100 g of vinyl acetate, 0.8 g of the macromonomer M-18, and 380 g of Isopar H was heated to 75° C. with stirring under nitrogen gas stream. Then, after adding thereto 0.8 g of A.I.B.N., the reaction was carried out for 4 hours and, after further adding thereto 0.4 g of A.I.B.N., the reaction was carried out for 2 hours. After 20 minutes since the addition of the polymerization initiator, the reaction mixture became white-turbid and the reaction temperature raised to 88° C. Then, after raising the temperature of the system to 100° C., the reaction mixture was stirred for one hour at the temperature to distil off unreacted vinyl acetate. After cooling, the reaction mixture was passed through a 200 mesh nylon cloth to obtain a latex having a mean grain size of 0.23 μm with a polymerization ratio of 88% as a white dispersion.

PRODUCTION EXAMPLE 20 OF LATEX GRAINS: D-17

A mixture of 7 g of the dispersion stabilizing resin P-62, 100 g of vinyl acetate, 0.6 g of the macromonomer M-19, and 385 g of Isopar H was heated to 70° C. with stirring under nitrogen gas stream. Then, after adding thereto 1.0 g of 2,2'-azobis(isovaleronitrile) (A.I.V.N.), the reaction was carried out for 2 hours and, after further adding thereto 0.4 g of A.I.V.N., the reaction was carried out for 2 hours. Thereafter, the temperature of the system was raised to 100° C. and the reaction mixture was stirred at the temperature to distil off remaining vinyl acetate. After cooling, the reaction mixture was passed through a 200 mesh nylon cloth to obtain a latex having a mean grain size of 0.22 μm with a polymerization ratio of 86% as a white dispersion.

PRODUCTION EXAMPLE 21 OF LATEX GRAINS: D-18 TO D-46

By following the same procedure as Production Example 20 of latex grains except that each of the compounds shown in Table 11 below was used in place of the dispersion stabilizing resin and the macromonomer, each of latex grains was produced. The polymerization ratios of the latex grains obtained were from 85 to 90%.

TABLE 11

| Production Example of Latex Grains | Latex Grains | Dispersion Stabilizing Resin | Amount (g) | Macromonomer | Amount (g) | Mean Grain Size of Latex Grains (μm) |
|---|---|---|---|---|---|---|
| 21 | D-18 | P-2 | 7 | M-12 | 0.8 | 0.20 |
| 22 | D-19 | P-3 | 8 | M-20 | 1.0 | 0.21 |
| 23 | D-20 | P-4 | 10 | M-25 | 1.0 | 0.20 |
| 24 | D-21 | P-5 | 10 | M-26 | 0.7 | 0.23 |
| 25 | D-22 | P-8 | 9 | M-14 | 1.0 | 0.20 |
| 26 | D-23 | P-9 | 9 | M-18 | 0.6 | 0.19 |
| 27 | D-24 | P-10 | 10 | M-21 | 1.2 | 0.18 |
| 28 | D-25 | P-11 | 9 | M-16 | 1.0 | 0.24 |
| 29 | D-26 | P-12 | 10 | M-11 | 1.2 | 0.23 |
| 30 | D-27 | P-13 | 9 | M-30 | 0.8 | 0.21 |
| 31 | D-28 | P-14 | 9 | M-42 | 0.8 | 0.20 |
| 32 | D-29 | P-15 | 11 | M-43 | 0.5 | 0.22 |
| 33 | D-30 | P-16 | 12 | M-10 | 1.2 | 0.25 |
| 34 | D-31 | P-17 | 12 | M-15 | 1.0 | 0.24 |
| 35 | D-32 | P-18 | 10 | M-17 | 1.5 | 0.23 |
| 36 | D-33 | P-19 | 8 | M-38 | 0.7 | 0.22 |
| 37 | D-34 | P-20 | 12 | M-40 | 1.2 | 0.18 |

TABLE 11-continued

| Production Example of Latex Grains | Latex Grains | Dispersion Stabilizing Resin | Amount (g) | Macromonomer | Amount (g) | Mean Grain Size of Latex Grains (μm) |
|---|---|---|---|---|---|---|
| 38 | D-35 | P-23 | 12 | M-41 | 1.3 | 0.20 |
| 39 | D-36 | P-24 | 6 | M-18 | 1.0 | 0.17 |
| 40 | D-37 | P-25 | 8 | M-12 | 1.5 | 0.18 |
| 41 | D-38 | P-27 | 8 | M-18 | 1.0 | 0.17 |
| 42 | D-39 | P-29 | 8 | M-32 | 1.0 | 0.17 |
| 43 | D-40 | P-31 | 7 | M-48 | 2.0 | 0.17 |
| 44 | D-41 | P-41 | 6 | M-27 | 0.5 | 0.20 |
| 45 | D-42 | P-50 | 7 | M-29 | 1.2 | 0.18 |
| 46 | D-43 | P-25 | 8 | M-26 | 2.0 | 0.20 |
| 47 | D-44 | P-58 | 8 | M-46 | 1.4 | 0.20 |
| 48 | D-45 | P-59 | 8 | M-47 | 2.0 | 0.21 |
| 49 | D-46 | P-63 | 9 | M-49 | 0.8 | 0.20 |

PRODUCTION EXAMPLE 50 OF LATEX GRAINS: D-47

A mixture of 9 g of the dispersion stabilizing resin P-7, 100 g of vinyl acetate, 5 g of crotonic acid, 0.8 g of the macromonomer M-38, and 468 g of Isopar H was heated to 70° C. with stirring under nitrogen gas stream and after adding thereto 1.3 g of A.I.V.N., the reaction was carried out for 6 hours. After raising the temperature of the system to 100° C., the reaction mixture was stirred for one hour at the temperature to distill off remaining vinyl acetate. After cooling, the reaction mixture was passed through a 2100 mesh nylon cloth to obtain a latex having a mean grain size of 0.19 μm with a polymerization ratio of 85% as a white dispersion.

PRODUCTION EXAMPLE 51 OF LATEX GRAINS: D-48

A mixture of 10 g of the dispersion stabilizing resin P-63, 100 g of vinyl acetate, 6.0 g of 4-pentenoic acid, 0.6 g of the macromonomer M-16, and 380 g of Isopar G was heated to 75° C. with stirring under nitrogen gas stream. After adding thereto 0.7 g of A.I.B.N., the reaction was carried out for 4 hours and, after further adding thereto 0.5 g of A.I.B.N., the reaction was carried out for 2 hours. After cooling, the reaction mixture was passed through a 200 mesh nylon cloth to obtain a latex having a mean grain size of 0.20 μm with a polymerization ratio of 86% as a white dispersion.

PRODUCTION EXAMPLE 52 OF LATEX GRAINS: D-49

A mixture of 10 g of the dispersion stabilizing resin P-62, 85 g of vinyl acetate, 15 g of N-vinylpyrrolidone, 0.7 g of the macromonomer M-18, and 380 g of n-decane was heated to 75° C. with stirring under nitrogen gas stream. After adding thereto 1.7 g of A.I.B.N., the reaction was carried out for 4 hours and, after further adding thereto 0.5 g of A.I.B.N., the reaction was carried out for 2 hours. After cooling, the reaction mixture was passed through a 200 mesh nylon cloth to obtain a latex having a mean grain size of 0.21 μm with a polymerization ratio of 88% as a white dispersion.

PRODUCTION EXAMPLE 53 OF LATEX GRAINS: D-50

A mixture of 14 g of the dispersion stabilizing resin P-43, 100 g of isopropyl methacrylate, 0.9 g of the macromonomer M-31, and 470 g of n-decane was heated to 70° C. with stirring under nitrogen gas stream and, after adding thereto 1.0 g of A.I.V.N., the reaction was carried out for 2 hours. Few minutes after the addition of the polymerization initiator, the reaction mixture began to become blue-turbid and the reaction temperature raised to 90° C. After cooling, the reaction mixture was passed through a 200 mesh nylon cloth to remove coarse grains, whereby a latex having a mean grain size of 0.25 μm with a polymerization ratio of 89% was obtained as a white dispersion.

PRODUCTION EXAMPLE 54 OF LATEX GRAINS: D-51

A mixture of 13 g of the dispersion stabilizing resin P-45, 100 g of styrene, 0.5 g of the macromonomer M-33, and 380 g of Isopar H was heated to 60° C. with stirring under nitrogen gas stream. After adding thereto 0.6 g of A.I.V.N., the reaction was carried out for 4 hours and, after further adding thereto 0.3 g of A.I.V.N., the reaction was carried out for 3 hours. After cooling, the reaction mixture was passed through a 200 mesh nylon cloth to obtain a latex having a mean grain size of 0.24 μm with a polymerization ratio of 83% as a white dispersion.

PRODUCTION EXAMPLE 55 OF LATEX GRAINS

Comparison Example D

By following the same procedure as Production Example 19 of latex grains except that the macromonomer M-18 was not used, a latex having a mean grain size of 0.25 μm was obtained with a polymerization ratio of 85% as a white dispersion.

PRODUCTION EXAMPLE 56 OF LATEX GRAINS

Comparison Example E

By following the same procedure as Production Example 19 except that a mixture of 8 g of a resin having the structure shown below produced according to the method described in JP-A-61-43757, 100 g of vinyl acetate, and 392 g of Isopar H was used, a latex having a mean grain size of 0.18 μm was obtained with a polymerization ratio of 86% as a white dispersion.

Resin:

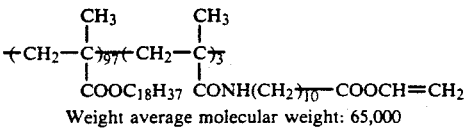

Weight average molecular weight: 65,000

PRODUCTION EXAMPLE 57 OF LATEX GRAINS

Comparison Example F

By following the same procedure as Example 19 except that a mixture of 18 g of poly(octadecyl methacrylate), 100 g of vinyl acetate, 1 g of a monomer (II) having the chemical structure shown below, and 385 g of Isopar H was used, a latex having a mean grain size of 0.24 μm was obtained with a polymerization ratio of 86% as a white dispersion. (The latex obtained corresponds to the latex grains disclosed in JP-62-151868).

Monomer (II):

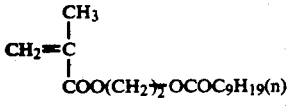

EXAMPLE 1

In a paint shaker (manufactured by Tokyo Seiki K.K.) were placed 10 g of a dodecyl methacrylate/acrylic acid copolymer (95/5 by weight ratio), 10 g of nigrosine and 30 g of Shellsol 71 together with glass beads and they were dispersed for 4 hours to obtain a fine dispersion of nigrosine.

Then, by diluting 30 g of the resin dispersion D-1 obtained in Production Example 1 of latex grains, 2.5 g of the aforesaid nitrosine dispersion, 15 g of a higher alcohol FOC-1400 (trade name made by Nissan Chemical Industries, Ltd.), and 0.08 g of an octadecyl vinyl ether/semi-maleic octadecylamide copolymer with one liter of Shellsol 71, a liquid developer for electrostatic photography was prepared.

Comparison Liquid Developers A, B, AND C

Three kinds of comparison liquid developers A, B, and C were prepared in the same manner as the aforesaid production example of liquid developer except that each of the following resin dispersions was used in place of the resin dispersion D-1.

Comparison Liquid Developers A

The resin dispersion obtained in Production Example 16 of latex grains was used.

Comparison Liquid Developers B

The resin dispersion obtained in Production Example 17 of latex grains was used.

Comparison Liquid Developers C

The resin dispersion obtained in Production Example 18 of latex grains was used.

An electrophotographic light-sensitive material, ELP Master II Type (trade name, made by Fuji Photo Film Co., Ltd.) was image-exposed and developed by a full-automatic processor, ELP 404V (trade name, made by Fuji Photo Film Co., Ltd.) using each of the liquid developers thus prepared. The processing (plate-making) speed was 5 plates/minute. Furthermore, after processing 2,000 plates of ELP Master II Type, the occurrence of stains of the developing apparatus by sticking of the toner was observed. The blackened ratio (imaged area) of the duplicated images was determined using 20% original. The results obtained are shown in Table 10 below.

TABLE 10

| Test No. | Liquid Developer | Stains of Developing Apparatus | Image of the 2,000th Plate |
|---|---|---|---|
| | Developer of Example 1 | No toner residue adhered | Clear |
| 2 | Developer A | Toner residue greatly adhered | Letter part lost, density of solid black lowered, background portion fogged |
| 3 | Developer B | Toner residue adhered slightly | Density of fine lines slightly lowered, Dmax lowered |
| 4 | Developer C | Toner residue adhered | Density of fine lines slightly lowered, Dmax lowered |

As is clear from the results shown above, when printing plates were produced by the aforesaid processing condition using each liquid developer, the liquid developer of this invention only caused no stains of the developing apparatus and gave clear images of the 2,000th plate.

Then, the offset printing master plate (ELP Master) prepared by processing using each of the liquid developers was used for printing in a conventional manner, and the number of prints obtained before occurrences of defects of letters on the images of the print, the lowering of the density of the solid black portions of the image, etc., was checked. The results showed that the master plate obtained by using each of the liquid developer of this invention and the liquid developers of Comparison Examples A and C gave more than 10,000 prints without accompanied by the aforesaid failures, while the master plate prepared using the comparison liquid developer B resulted in the failures after 8,000 prints.

As is clear from the aforesaid results, only the liquid developer of this invention could advantageously be used for preparing a large number of prints by the master plate without causing stains of the developing apparatus.

In the case of using Comparison Liquid Developer A, there was no problem on the number of prints, but the developing apparatus was too stained to further use continuously.

Also, in the cases of Comparison Liquid Developers B and C, the developing apparatus was stained (in particular), on the back surface of the electrode plate) when the developer was used under the condition of a rapid processing speed as 5 plates/minute (an ordinary processing speed was 2 or 3 plates/minute) and after the formation of about 2,000 plates, the image quality of the duplicated images on the plate was reduced (the reduction of Dmax, lowering of the density of fine lines, etc.). There was no problem on the number of prints by the master plate in the case of using the Comparison Liquid Developer C, but the number thereof was lowered in the case of using the Comparison Liquid Developer B.

These results show that the resin grains of this invention are clearly excellent.

EXAMPLE 2

A mixture of 100 g of the white resin dispersion D-100 obtained in Production Example 1 of latex grains and 1.5 g of Sumikalon Black was heated to 100° C. with stirring for 4 hours. After cooling to room temperature, the reaction mixture was passed through a 200 mesh nylon cloth to remove the remaining dye, thereby a black resin dispersion having a mean grain size of 0.20 μm was obtained.

A liquid developer was prepared by diluting 32 g of the aforesaid black resin dispersion and 0.05 g of zirconium naphthenate with one liter of Shellsol 71.

When the liquid developer was applied to the same developing apparatus as in Example 1, no occurrence of stains of the developing apparatus by sticking of the toner was observed even after developing 2,000 plates.

Also, the quality of the offset printing master plate obtained was clear and also the image quality of the 10,000 print formed using the master plate was very clear.

EXAMPLE 3

A mixture of 100 g of the white resin dispersion obtained in Production Example 36 of latex grains and 3 g of Victoria Blue B was heated to a temperature of from 70° C. to 80° C. with stirring for 6 hours. After cooling to room temperature, the reaction mixture was passed through a 200 mesh nylon cloth to remove the remaining dye, thereby a blue resin dispersion having a mean grain size of 0.25 μm was obtained.

A liquid developer was prepared by diluting 32 g of the aforesaid blue resin dispersion, 0.05 g of zirconium naphthenate and 10 g of a higher alcohol, FOC-1600 (trade name, made by Nissan Chemical Industries, Ltd.) with one liter of Isopar H.

When the liquid developer was applied to the same developing apparatus as in Example 1, no occurrence of stains of the developing apparatus by sticking of the toner was observed even after developing 2,000 plates. Also, the image quality of the offset printing master plate obtained was clear and also the image quality of the 10,000th print was very clear.

EXAMPLE 4

By diluting 32 g of the white resin dispersion obtained in Production Example 2 of latex grains, 2.5 g of the nigrosine dispersion obtained in Example 1, and 0.02 g of a semi-docosanylamidated product of a copolymer of diisobutyrene and maleic anhydride with one liter of Isopar G, a liquid developer was prepared.

When the liquid developer was applied to the same developing apparatus as in Example 1, no occurrence of stains of the developing apparatus by sticking of the toner was observed even after developing 2,000 plates. Also, the image quality of the offset printing master plate obtained and also the image quality of the 10,000th print obtained using the master plate were very clear.

Furthermore, when the same processing as above was applied after allowing to stand the liquid developer for 3 months, the results were the same as above.

EXAMPLE 5

In a paint shaker were placed 10 g of poly-(decylmethacrylate), 30 g of Isopar H, and 8 g of Alkali Blue together with glass beads followed by dispersing for 2 hours to provide a fine dispersion of Alkali Blue.

A liquid developer was prepared by diluting 30 g of the white resin dispersion D-11 obtained in Production Example 11 of latex grains, 4.2 g of the aforesaid Alkali Blue dispersion, and 0.06 g of a semidocosanylaminated product of a copolymer of octadecyl vinyl ether and maleic anhydride with one liter of Isopar G.

When the liquid developer was applied to the same developing apparatus as in Example 1, no occurrence of stains of the developing apparatus by sticking of the toner was observed even after developing 2,000 plates. Also, the image quality of the offset printing master plate obtained and the image quality of the 10,000th print obtained using the master plate were very clear.

EXAMPLES 6 TO 13

By following the same procedure as Example 1 except that each of the latex grains D-3 to D-10 shown in Table 13 below was used in place of the latex grains D-1, each of liquid developers was prepared.

TABLE 13

| Example | Latex Grains |
|---|---|
| 6 | D-3 |
| 7 | D-4 |
| 8 | D-5 |
| 9 | D-6 |
| 10 | D-7 |
| 11 | D-8 |
| 12 | D-9 |
| 13 | D-10 |

When each of the liquid developers was applied to the same developing apparatus as in Example 1, no occurrence of stains of the developing apparatus by sticking of the toner was observed even after developing 2,000 plates. Also, the image quality of the 10,000th print obtained using each of the master plates were very clear.

EXAMPLE 14

In a paint shaker (manufactured by Tokyo Seiki K.K.) were placed 10 g of a dodecyl methacrylate/acrylic acid copolymer (95/5 by weight ratio), 10 g of nigrosine and 30 g of Shellsol 71 together with glass beads followed by dispersing for 4 hours to provide a fine dispersion of nigrosine.

A liquid developer was prepared by diluting 30 g of the resin dispersion D-16 obtained in Production Example 19 of latex grains, 2.5 g of the aforesaid nigrosine dispersion, 15 g of a higher alcohol, FOC-1400 (trade name, made by Nissan Chemical Industries, Ltd., tetradecyl alcohol), and 0.08 g of a copolymer of octadecene and semi-maleic octadecylamide with one liter of Shellsol 71.

Comparison Liquid Developers D, E, and F

Three kinds of comparison liquid developers D, E, and F were prepared using the following resin dispersions shown below in the aforementioned production method.

Comparison Liquid Developers D

The resin dispersion obtained in Production Example 55 of latex grains was used.

Comparison Liquid Developers E

The resin dispersion obtained in Production Example 56 of latex grains was used.

Comparison Liquid Developers F

The resin dispersion obtained in Production Example 57 of latex grains was used.

An electrophotographic light-sensitive material, ELP Master II Type (trade name, made by Fuji Photo Film Co., Ltd.) was image exposed and developed by a full-automatic processor, ELP 404V (trade name, made by Fuji Photo Film Co., Ltd.) using each of the liquid developers. The processing speed (plate-making speed) was 5 plates/minute. Furthermore, the occurrence of stains of the developing apparatus by sticking of the toner after processing 2,000 plates of ELP Master II Type was checked. The blackened ratio (imaged area) of the duplicated image was determined using 30% original.

The results obtained are shown in Table 14 below.

TABLE 14

| Test No. | Developer | Stains of Developing Apparatus | Image of the 2000th Plate |
|---|---|---|---|
| 1 | Developer of the example | No toner residue adhered | Clear |
| 2 | Developer D | Toner residue greatly adhered | Letter parts lost, density of solid black part lowered, background fogged |
| 3 | Developer E | Toner residue adhered | Density of fine lines slightly lowered, Dmax lowered |
| 4 | Developer F | Toner residue adhered | Density of fine lines slightly lowered, Dmax lowered |

When each of the liquid developers was used for plate making under the aforesaid processing conditions, only the liquid developer of this invention caused no stains of the developing apparatus and gave clear images on the 2,000th plate.

Then, the offset printing master plate (ELP Master) prepared by processing using each of the liquid developers was used for printing in a conventional manner and the number of prints obtained before the occurrences of defects of letters on the images of the print, the lowering of the density of the solid black portions of the images, etc., was checked. The results showed that the master plate obtained by using each of the liquid developer of this invention and the liquid developers in Comparison Examples D and F gave more than 10,000 prints without accompanied by the aforesaid failures, while the master plate prepared using the comparison liquid developer E results in the failures after 8,000 prints.

As is clear from the aforesaid results, only the liquid developer of this invention could advantageously be used for preparing a large number of prints by the master plate obtained without causing stains of the developing apparatus.

In the case of using the comparison developer D, there was no problem on the number of prints, but the developing apparatus was too stained to further use continuously.

Also, in the cases of Comparison Liquid Developers E and F, the developing apparatus was stained (in particular, on the back surface of the electrode plate) when the developer was used under the condition of a rapid processing speed of 5 plates/minute (an ordinary processing speed was 2 or 3 plates/minute) and after the formation of about 2,000 plates, the image quality of the duplicated images on the plate was reduced (the reduction of Dmax, lowering of the density of fine lines, etc.). There was no problem on the number of prints by the master plate in the case of using Comparison Liquid Developer F, but the number thereof was reduced in the case of using Comparison Liquid Developer E.

These results show that the resin grains of this invention are clearly excellent.

EXAMPLE 15

A mixture of 100 g of the white dispersion obtained in Production Example 20 of latex grains and 1.5 g of Sumikalon Black was heated to 100° C. with stirring for 4 hours. After cooling to room temperature, the reaction mixture was passed through a 200 mesh nylon cloth to remove the remaining dye, thereby a black resin dispersion having a mean grain size of 0.25 μm was obtained.

A liquid developer was prepared by diluting 32 g of the aforesaid black resin dispersion, 20 g of a higher alcohol, FOC-1600 (trade name, made by Nissan Chemical Industries, Ltd., hexadecyl alcohol), and 0.05 g of zirconium naphthenate with one liter of Shellsol 71.

When the liquid developer was applied to the same developing apparatus as in Example 1 for development, no occurrence of stains of the developing apparatus by sticking of the toner was observed even after developing 2,000 plates.

Also, the image quality of the offset printing master plate obtained was clear and the image quality of the 10,000th print obtained using the master plate was very clear.

EXAMPLE 16

A mixture of 100 g of the white resin dispersion obtained in Production Example 51 of latex grains and 3 g of Victoria Blue was heated to a temperature of from 70° C. to 80° C. with stirring for 6 hours. After cooling to room temperature, the reaction mixture obtained was passed through a 200 mesh nylon cloth to remove the remaining dye, thereby a blue resin dispersion having a mean grain size of 0.25 μm was obtained.

A liquid developer was prepared by diluting 32 g of the aforesaid blue resin dispersion, and 0.05 g of zirconium naphthenate with one liter of Isopar H.

When the liquid developer was applied to the same developing apparatus as in Example 1 for development, no occurrence of stains of the developing apparatus by sticking of the toner was observed even after developing 2,000 plates. Also, the image quality of the offset printing master plate obtained was clear and the image quality of the 10,000th print obtained using the master plate was very clear.

EXAMPLE 17

A liquid developer was prepared by diluting 32 g of the white resin dispersion obtained in Production Example 21 of latex grains, 2.5 g of the nigrosine dispersion obtained in Example 14, 15 g of a higher alcohol, FOC-1800 (trade name, made by Nissan Chemical Industries, Ltd., octadecyl alcohol) and 0.02 g of a semi-docosanylamidated product of a copolymer of diisobutyrene and maleic anhydride with one liter of Isopar G.

When the liquid developer was applied to the same developing apparatus as in Example 14 for development, no occurrence of stains of the developing apparatus by sticking of the toner was observed. Also, the image quality of the offset printing plate obtained and the image quality of the 10,000th print obtained using the master plate were clear.

Furthermore, when the same processing was performed after allowing to stand the liquid developer for 3 months, the results were the same as above.

EXAMPLE 18

A liquid developer was prepared by following the same procedure as Example 5 except that 30 g of the white resin dispersion obtained in Production Example 41 of latex grains was used in place of the white resin dispersion D-11.

When the liquid developer was applied to the same developing apparatus as in Example 14 for development, no occurrence of stains of the developing apparatus by sticking of the toner was observed. Also, the image quality of the offset printing master plate obtained and the image quality of the 10,000th print obtained using the master plate were very clear.

EXAMPLES 32 TO 53

By following the same procedure as Example 18 except that each of the latexes shown in Table 15 below was used in place of the latex D-38 obtained in Production Example 41 of latex grains, each of liquid developers was prepared.

TABLE 15

| Example | Latex Grains | Example | Latex Grains |
|---|---|---|---|
| 19 | D-16 | 30 | D-30 |
| 20 | D-17 | 31 | D-31 |
| 21 | D-19 | 32 | D-32 |
| 22 | D-20 | 33 | D-33 |
| 23 | D-21 | 34 | D-36 |
| 24 | D-22 | 35 | D-37 |
| 25 | D-23 | 36 | D-39 |
| 26 | D-24 | 37 | D-40 |
| 27 | D-25 | 38 | D-44 |
| 28 | D-26 | 39 | D-45 |
| 29 | D-27 | 40 | D-46 |

When each of the liquid developers was applied to the same developing apparatus as in Example 14 for development, no occurrence of stains of the developing apparatus for development by sticking of the toner was observed even after developing 2,000 plates.

Also, the image quality of the offset printing master plate obtained was clear and the image quality of the 10,000th print obtained using the master plates was very clear.

Furthermore, when the aforesaid processing was repeated after allowing to stand each of the liquid developers for 3 months, the results were the same as above.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic photography comprising resin grains dispersed in a non-aqueous solvent having an electric resistance of at least $10^9$ cm and a dielectric constant of not higher than 3.5, wherein the dispersed resin grains are grains of a copolymer obtained by polymerizing a solution containing at least one monofunctional monomer (A) which is soluble in the aforesaid non-aqueous solvent, but becomes insoluble after being polymerized and at least one monofunctional macromonomer (M) having a number average molecular weight of not more than $1\times10^4$ and having a polymerizable double bond group represented by the following formula (M-II) bonded to only one terminal of a polymer main chain composed of a recurring unit represented by the following formula (M-I) in the presence of a dispersion stabilizing resin which is a polymer having at least a recurring unit represented by the following formula (I), a part of which has been crosslinked, and has a polymerizable double bond group copolymerizable with the monofunctional monomer (A) bonded to only one terminal of at least one polymer main chain thereof, said dispersion stabilizing resin being soluble in the non-aqueous solvent;

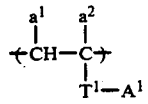

(I)

wherein $T^1$ represents —COO—, —OCO—, —$CH_2$OCO—, —$CH_2$COO—, —O—, or —$SO_2$—; $A^1$ represents an aliphatic group having from 6 to 32 carbon atoms; and $a^1$ and $a^2$, which may be the same or different, each represents a hydrogen atom, a halogen atom, a cyano group, a hydrocarbon group having from 1 to 8 carbon atoms, —COO—$Z^1$, or —COO—$Z^1$ bonded via a hydrocarbon group having from 1 to 8 carbon atoms (wherein $Z^1$ represents a hydrogen atom or a hydrocarbon group having from 1 to 18 carbon atoms);

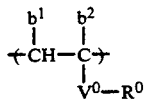

(M-I)

wherein $V^0$ represents —COO—, —OCO—, $\text{-}(CH_2)_l\text{-}$—COO—, $\text{-}(CH_2)_l\text{-}$OCO—, —O—, —$SO_2$—, —CONHCOO—, -CONHCONH-, —CON—,

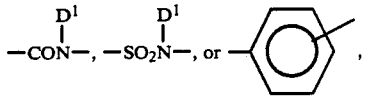

(wherein $D^1$ represents a hydrogen atom or a hydrocarbon group having from 1 to 22 carbon atoms and l represents an integer of from 1 to 3); $R^o$ represents a hydrocarbon group having from 1 to 22 carbon atoms, said $R^o$ may, however, contain —O—, —CO—, —$CO_2$—, —OCO—, —$SO_2$—,

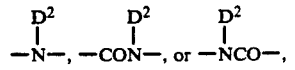

wherein $D^2$ has the same significance as $D^1$, in the carbon chain; and $b^1$ and $b^2$, which may be the same or different, each represents a hydrogen atom, a halogen atom, a cyano group, a hydrocarbon group having from 1 to 8 carbon atoms, —COO$D^3$, or —COO—$D^3$ bonded via a hydrocarbon group having from 1 to 8 carbon atoms wherein $D^3$ represents a hydrogen atom or a hydrocarbon group having from 1 to 8 carbon atoms which may be substituted;

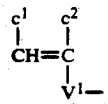

(M-II)

wherein $V^1$ has the same significance as $V^o$ of formula (M-I) and $c^1$ and $c^2$, which may be the same or different, have the same meaning as $b^1$ and $b^2$ of formula (M-I).

2. The liquid developer for electrostatic photography as in claim 1, wherein the recurring unit represented by formula (M-I) in the monofunctional macromonomer (M) includes at least a recurring unit represented by the following formula (M-Ia)

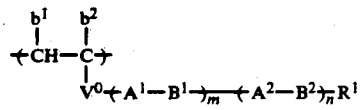

(M-Ia)

wherein $b^1$, $b^2$, and $V^o$ are same a those in formula (M-I); $R^1$ represents a hydrogen atom or a hydrocarbon group having from 1 to 22 carbon atoms; $B^1$ and $B^2$, which may be the same or different, each represents —O—, —CO—, $—CO_2—$, —OCO—, $—SO_2—$,

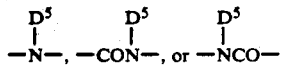

wherein $D^5$ has the same meaning as $D^1$ in formula (M-I); $A^1$ and $A^2$, which may be same or different, each represents a hydrocarbon group having from 1 to 18 carbon atoms, which may be substituted or may have

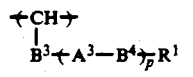

in the main chain bond, wherein $B^3$ and $B^4$, which may be the same or different, have the same meaning as aforesaid $B^1$ and $B^2$ and $A^3$ represents a hydrocarbon group having from 1 to 18 carbon atoms, which may be substituted; and m, n, and p each represents an integer of from 0 to 3, with the proviso that m, n, and p cannot be 0 at the same time.

3. The liquid developer for electrostatic photography as in claim 1, wherein said dispersion stabilizing resin contains the monomer corresponding to the recurring unit represented by formula (I) in a proportion of at least 30 parts by weight per 100 parts by weight of the whole monomers of said dispersion-stabilizing resin.

4. The liquid developer for electrostatic photography as in claim 1, wherein said dispersion stabilizing resin has a weight average molecular weight of from $1\times10^4$ to $1\times10^6$.

5. The liquid developer for electrostatic photography as in claim 1, wherein said monofunctional monomer (A) is represented by formula (A-I):

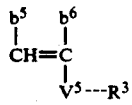

(A-I)

wherein $V^5$ represents —COO—, —OCO—, $—CH_2OCO—$, $—CH_2COO—$, —O—, —CONHCOO—, —CONHOCO—, $—SO_2—$,

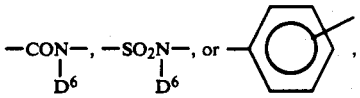

wherein $D^6$ represents a hydrogen atom or an aliphatic group having from 1 to 18 carbon atoms which may be substituted, $R^3$ represents a hydrogen atom or an aliphatic group having from 1 to 6 carbon atoms which may be substituted, and $b^5$ and $b^6$, which may be the same or different, each represents a hydrogen atom, a halogen atom, a cyano group, a hydrocarbon group having 1 to 8 carbon atoms, —COO—$D^3$, or —COO—$D^3$ bonded via a hydrocarbon group having from 1 to 8 carbon atoms, and wherein $D^3$ represents a hydrogen atom or a hydrocarbon group having from 1 to 8 carbon atoms which may be substituted.

6. The liquid developer for electrostatic photography as in claim 1, wherein said monofunctional macromonomer (M) contains a recurring unit represented by formula (M-I) in an amount of at least 40% by weight.

7. The liquid developer for electrostatic photography as in claim 1, wherein said macromonomer (M) has a number average molecular weight of from $1\times10^3$ to $1\times10^4$.

8. The liquid developer for electrostatic photography as in claim 1, wherein said liquid developer further contains a coloring agent.

* * * * *